US011585566B2

(12) United States Patent
Conley

(10) Patent No.: US 11,585,566 B2
(45) Date of Patent: Feb. 21, 2023

(54) HVAC/R CONDENSATE TRAP

(71) Applicant: Kenneth Eugene Conley, Kalispell, MT (US)

(72) Inventor: Kenneth Eugene Conley, Kalispell, MT (US)

( * ) Notice: Subject to any disclaimer, the term of this patent is extended or adjusted under 35 U.S.C. 154(b) by 802 days.

(21) Appl. No.: 15/472,099

(22) Filed: Mar. 28, 2017

(65) Prior Publication Data

US 2018/0283767 A1 Oct. 4, 2018

(51) Int. Cl.
*F24F 13/22* (2006.01)
*F28F 17/00* (2006.01)
*F24F 140/30* (2018.01)

(52) U.S. Cl.
CPC ..... *F24F 13/222* (2013.01); *F28F 17/005* (2013.01); *F24F 2140/30* (2018.01)

(58) Field of Classification Search
CPC ..... F24F 13/222; F24F 2140/30; F28F 17/005
See application file for complete search history.

(56) References Cited

U.S. PATENT DOCUMENTS 2,244,256 A * 6/1941 Looman ..... E21B 36/04 417/313
5,497,809 A * 3/1996 Wolf ..... B21D 9/04 138/148
6,860,991 B1 * 3/2005 Hagon ..... E03C 1/29 210/163
6,992,259 B1 * 1/2006 Cantolino ..... H01H 35/18 200/84 R
7,686,034 B1 * 3/2010 Coogle ..... F16L 55/07 137/268
2003/0168780 A1 * 9/2003 Johns ..... B21D 45/02 264/334
2012/0258656 A1 * 10/2012 Raimondi ..... F24F 13/082 454/367
2018/0283767 A1 * 10/2018 Conley ..... F28F 17/005

OTHER PUBLICATIONS http://c-trap.com/, Aug. 2016, Accessed via http://web.archive.org (Year: 2016).*

* cited by examiner

*Primary Examiner* — Larry L Furdge
(74) *Attorney, Agent, or Firm* — Kilpatrick Townsend & Stockton LLP

(57) ABSTRACT

A condensate trap for providing improved gas seal to a heating, ventilation, air conditioning, and refrigeration (HVAC/R) system. The trap can include an interior reservoir containing a volume of fluid to create a gas seal between an inlet pathway and an output. The interior reservoir can be accessed through an access port, by removing a removable cover, for maintenance and inspection. The trap can include vents or vent precursors for aiding in drainage of excess fluid, as well as early detection of problem conditions. The trap can be made from modified parts put together in a specific manner, or through purpose-built parts. The trap can include liquid level sensors and inspection windows to aid in early detection of problem conditions.

9 Claims, 13 Drawing Sheets

HVAC/R CONDENSATE TRAP

TECHNICAL FIELD

The present disclosure relates to a condensate trap generally and more specifically to condensate traps for use in connection to heating, ventilation, air conditioning and refrigeration (HVAC/R) units.

BACKGROUND

A condensate trap may be used in connection with a heating, ventilation, air conditioning, and refrigeration (HVAC/R) system to enable reliable drainage of excess condensate. Condensate builds up on evaporator coils in the HVAC/R system and can be collected in a condensate pan at the bottom of the unit. This collected condensate can be diverted, via a drainage outlet, to a location for suitable drainage, such as onto outdoor ground or into a drain pipe (e.g., municipal drain). Excess standing moisture in the condensate pan may cause unhealthy living conditions (e.g., due to a buildup of bacteria, fungus, or algae). Excess condensate collecting in the condensate pan may cause damage to the HVAC/R equipment, requiring costly repairs or replacement of the unit. Excess condensate may also leak out of the condensate pan and cause damage to surrounding structures or equipment.

Depending on an HVAC/R system's current setting, a drainage outlet of a condensate pan may experience negative, such as due to air being forced through the HVAC/R system by the system's air handler or fan. Under negative pressure, certain HVAC/R systems may inhale air through the drainage outlet, which may cause major problems. Such negative pressure can prevent excess condensate from draining, causing the condensate pan to overflow. Additionally, sufficiently high negative pressure may pull excess condensate through equipment of the HVAC/R system that can be damaged from exposure to moisture. A trap may be attached to the drainage outlet of the HVAC/R unit to allow condensate to drain, while preventing air from being pulled in through the drainage outlet due to negative pressure.

Condensate traps make use of liquid, such as purged condensate, to form a gas barrier to prevent the drainage outlet from inhaling air when the HVAC/R system is running. A P-trap is a commonly used trap made from a reformed section of pipe, such as polyvinyl chloride (PVC) pipe, which has been heated and bent into shape that resembles a letter P. The P-trap is installed with the curved section of the P pointing downwards so that condensate builds up in the curved section thereby forming the necessary gas seal. P-traps can be very difficult to clean and can be problematic to install. If the trap becomes clogged, condensate may not drain and the condensate may back into the HVAC/R system causing damage. Cleaning a P-trap requires cutting the pipe to access and clean the interior of the pipe before gluing it back into place, or simply replacing the P-trap entirely. Additionally, during install, an installer must cut, fit, and glue the piping on site which is an error prone process.

Another common trap uses a series of 90 degree fittings to form a loop similar to the loop of the P-trap. Installing this type of trap requires cutting and gluing together several sections of PVC pipe between multiple 90 degree fittings to create the desired shape. The hard 90 degree angles can frequently form blockages, causing the condensate to backup. Also, because many different parts are used, it can be difficult to clean the trap. The trap must be cut and removed to be cleaned, then refitted and re-glued. Like the P-trap, installing, cutting, and gluing this type of trap is can be an error prone process that must be done on site. Further, the resulting trap takes up considerable space and can be prone to damage if jostled.

Additionally, an installer installing a trap may need to install a vent to ensure condensate in the drain pipe is able to flow from the trap to the drain without a vacuum forming within the drain pipe. While a vent performs well when installed correctly between the trap and the output of the drain pipe, a vent installed incorrectly (e.g., between the trap and the condensate pan) can render the trap ineffective since negative pressure from the drainage outlet would pull air through the vent. Many traps and vents are installed incorrectly every year, leading to the same problems that occur when no trap is used at all.

Condensate traps that are presently used in the art are prone to installation error, damage, and general failure. Therefore, a need exists for an improved condensate trap that overcomes the disadvantages found in the prior art.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
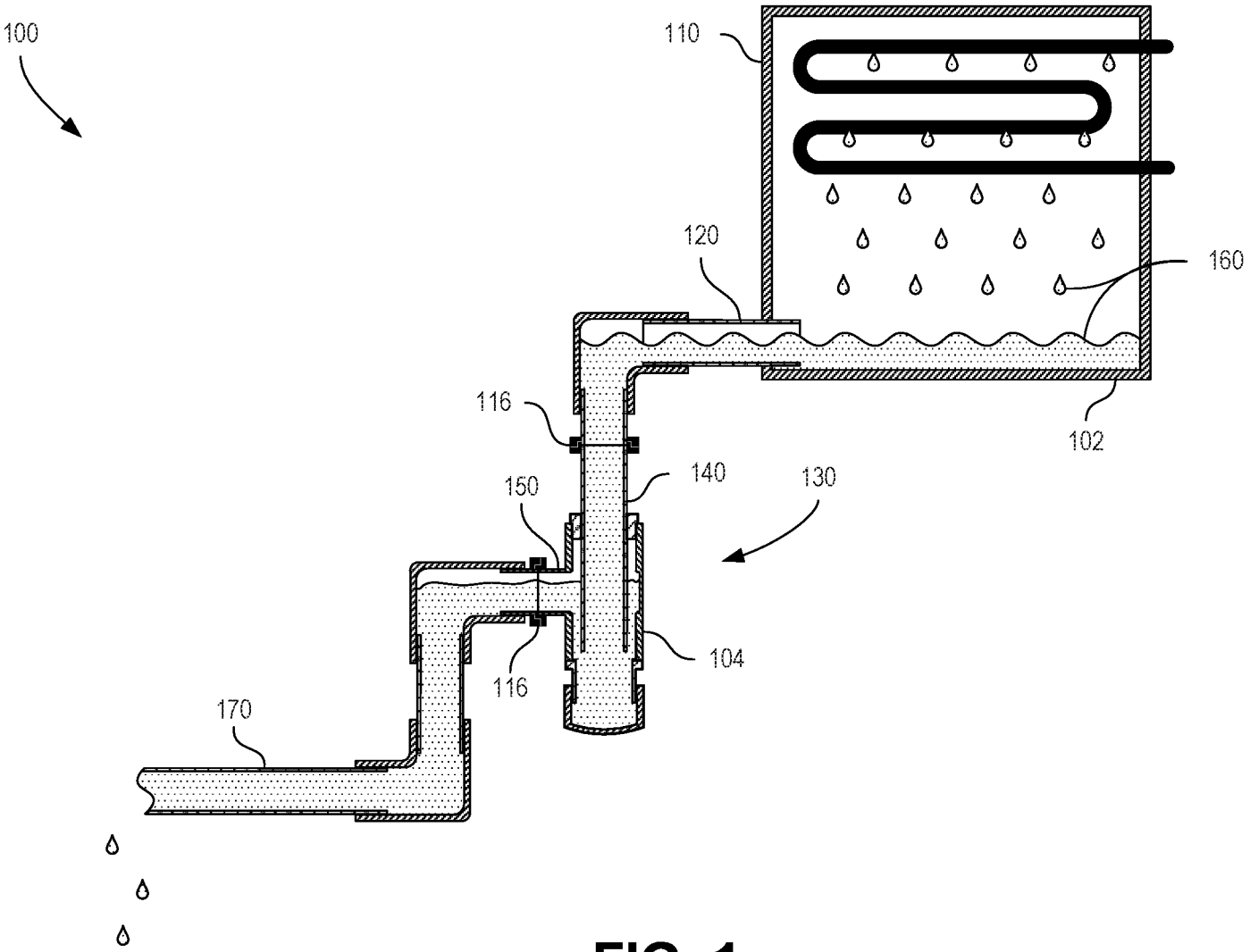
FIG. 1 is a schematic diagram depicting a cross-sectional view of a condensate trap as part of an overall HVAC/R drainage system according to certain aspects of the present disclosure.

Certain aspects and features of the present disclosure relate to a condensate trap for use in communication with heating, ventilation, air conditioning, and refrigeration (HVAC/R) units that overcomes disadvantages in the art by presenting a compact design that is efficient and simple to install and maintain. As used herein, the condensate trap is disclosed with reference to HVAC/R units, however certain aspects and features of the present disclosure can be equally applicable to any units generating condensation irrespective of whether they contain equipment for each of heating, ventilation, air conditioning, and/or refrigeration. For example, the condensate trap disclosed herein can be used with a unit that provides ventilation and air conditioning, without providing and heating.

Certain aspects of the present disclosure include a condensate trap, such as for use with a heating, ventilation, air conditioning, and refrigeration (HVAC/R) system. The condensate trap can comprise a main body having a condensate inlet and a condensate outlet. The condensate inlet can be located at or near the top of the main body and can accept condensate (e.g., from an attached HVAC/R system) into an internal reservoir via an inlet pathway. Condensate can thus collect within the internal reservoir. The condensate outlet can be located on the main body to allow excess condensate collected in the internal reservoir to drain away through the condensate outlet once the level of the internal reservoir rises above a drainage level. To ensure a sufficient gas seal is maintained in the trap, the inlet pathway can extend into the internal reservoir, past the drainage level, to an inlet level. The inlet level can be located sufficiently lower than the drainage level such that negative pressure applied at the condensate inlet (e.g., from an air handler of a coupled HVAC/R system) would not be able to displace the amount of liquid that would be necessary to break the gas seal. In some cases, the condensate outlet can have a larger size (e.g., larger cross-sectional area) than the condensate inlet.

The working height of the gas seal can be defined as the difference between the bottom of the inlet pathway and the bottom of the condensate outlet, or the difference between the inlet level and the drainage level. The gas seal can function as intended as long as the negative pressure in the condensate inlet that is created by the HVAC/R system is not sufficient to displace the volume of water in the internal reservoir within the bounds of the working height of the seal. In other words, if the negative pressure is strong enough to displace the water in the internal reservoir between the drainage level and the inlet level, the level of standing condensate within the trap will fall below the inlet pathway and allow air to be sucked into the inlet pathway. The disclosed condensate trap allows for a gas seal to be formed within a body having a relatively large diameter (e.g., as compared to existing condensate traps, such as P-traps). This relatively large diameter means that the necessary working height of the gas seal can be smaller (e.g., as compared to existing condensate traps, such as P-traps), and thus the overall height of the trap can be minimized, allowing for more versatile placement options during installation.

In some cases, the condensate trap can include an access port for accessing the internal reservoir, such as for cleaning or draining the internal reservoir. The access port can be located at or near the bottom of the trap, and can comprise a lower opening covered by a removable cover that forms a liquid tight seal when affixed to the lower opening.

In some cases, the condensate trap can include one or more air holes in fluid communication with the internal reservoir and the condensate outlet. The air holes can permit air to flow into the internal reservoir and/or into the condensate outlet to displace condensate being drained out through the condensate outlet. The air holes can be separated from the condensate inlet by the inlet pathway and/or the gas seal (e.g., when the condensate trap is in use and filled with a persistent level of liquid), thus ensuring air is not allowed to pass through the condensate inlet and into the HVAC/R system from the condensate trap. The air holes can be located at or near the top of the main body. The air holes can be located at any suitable location above the drainage level of the condensate trap, such as above an expected operating level of the condensate trap. The expected operating level can be a maximum level of condensate expected to build up within the main body during normal use. In some cases, the maximum level can be at or near the top of the main body. In some cases, the air holes can also act as a clog indicator. When the air holes are located at or above a desired maximum operating level (e.g., an expected operating level), the air holes can indicate a clog may be present when condensate is seen leaking out of the air holes instead of all of the condensate draining through the condensate outlet. The presence of condensate leaking out of the air holes can indicate that a clog has occurred somewhere downstream of the trap (e.g., in or after the condensate outlet) and thus condensate is not draining appropriately, resulting in condensate building up within the trap above a maximum operating level and leaking out through the air holes.

In some cases, a condensate trap according to the present disclosure can be manufactured from off-the-shelf plumbing parts specifically modified and assembled together as described in further detail herein. The parts can include a reducing tee fitting, a reducing bushing, a section of pipe, a street male adapter, and a threaded cap. The parts can be made of any suitable material, such as PVC, transparent PVC, chlorinated polyvinyl chloride (CPVC), galvanized steel, iron, copper, brass, or any suitable material. The reducing tee fitting can have a top opening and a bottom opening concentrically located along a primary axis of the fitting, and a side opening located between the top and bottom openings and lying in a plane parallel to and offset from the primary axis. The side opening can define the condensate outlet. The bottom opening can be fitted with the street male adapter, which can include a threaded portion that extends beyond the opening of the reducing tee fitting. The threaded portion enables the removable cover to be removably affixed to the opening of the reducing tee fitting for providing a liquid tight seal when the cover is in place and access to the interior of the reducing tee fitting when the cover is removed. The street male adaptor and removable cover can define the access port of the condensate trap. The internal reservoir of the condensate trap can be defined, at least in part, by the interior walls of the reducing tee fitting, the interior walls of the street male adaptor, and the cover. The reducing bushing can be affixed to the top opening of the reducing tee fitting to accept the pipe section. A reducing bushing generally includes an interior shoulder circumscribing the interior surface of the bushing to aid in seating and securing a pipe section within the bushing and to ensure the bushing cannot be pushed too far onto the pipe section. This interior shoulder can be removed when constructing a condensate trap, allowing the pipe section to be placed completely through the opening of the bushing. The pipe section can be placed through the bushing sufficiently far enough to ensure a bottom end of the pipe section is located within the reducing tee fitting at a location below the side opening of the tee fitting. The pipe section can define the inlet pathway of the condensate trap. The pipe section can be connected to an HVAC/R system to accept condensate which passes through the pipe and into the interior reservoir, where the condensate pools. The condensate will pool up until it reaches the bottom of the side opening of the reducing tee fitting, whereupon the condensate will begin to drain out of the side opening. Because the bottom of the pipe section is located within the reducing tee fitting and below the bottom of the side opening of the reducing tee fitting, the condensate level within the internal reservoir will remain above the bottom of the pipe section, thereby allowing the liquid condensate to create a gas barrier between the pipe section leading to the HVAC/R system and the side opening of the reducing tee fitting leading to the drain. The plane that passes through the bottom of the pipe section and is perpendicular to the primary axis of the reducing tee fitting can define the inlet level, or the level at which point the condensate supplied from the HVAC/R system is expelled from the inlet pathway into the interior reservoir.

In some cases, the pipe section can be coupled to the reducing bushing using PVC cement or any other suitable affixing agent. Unexpectedly, it has been determined that simply installing the pipe section from the top of the reducing bushing is disadvantageous and can result in an insufficient seal. A better seal can be obtained by installing the pipe section by pushing the pipe section through the reducing bushing from the bottom (e.g., from the side facing the interior of the reducing tee fitting) towards the top. It has been further determined that an improved seal can be formed by applying affixing agent to the exterior of the pipe section when the pipe section is coupled to the bushing, rather than applying glue to the interior surface of the bushing. Affixing agent applied to the interior surface of the bushing can inadvertently spread onto the end of the pipe section, which can result in an uneven surface that is difficult to properly couple and seal to an HVAC/R system. It has been determined that a condensate trap can be unexpectedly improved by coupling the pipe section to the reducing bushing by applying affixing agent to an exterior surface of the pipe section, passing the pipe section through the reducing bushing from a bottom side towards a top side, and positioning the bushing and pipe section with respect to one another at a desired distance for the inlet level. In some cases, the pipe section and reducing bushing can be coupled together prior to coupling the resultant assembly onto the reducing tee fitting. In other cases, the various parts of the condensate trap can be assembled in any suitable order.

In some cases, the reducing bushing or the reducing tee fitting can be further modified to include one or more air vents. The air vents can be any suitable shape, such as holes or slots. The air vents can be simple apertures or can be adjustable (e.g., to change the size of the openings). In some cases, the reducing bushing or reducing tee fitting can be modified by forming holes for the air vents. In some cases, a condensate trap can include guides or markings indicating desirable locations for air vents so that an installer can create the desired air vents at the desired locations. In some cases, a condensate trap can include one or more breakouts that are weakened portions of the trap capable of being punctured, ruptured, dislodged, or otherwise broken away from the remainder of the trap to reveal air vents. In some cases, a condensate trap can be pre-manufactured to include one or more air vents which can be plugged, such as with included plugs or available sealant (e.g., silicone).

In some cases, the inlet pathway can be set to a predetermined working height of the gas seal. However, in some cases, the inlet pathway can be adjustable to accommodate different working heights of the gas seal, as needed. A larger working height (e.g., deeper inlet pathway) can be used in HVAC/R systems that produce a stronger vacuum force (e.g., a strong air handler), whereas a smaller working height may be suitable for HVAC/R systems that produce a weaker vacuum force. Because the inlet pathway is further from the base of the main body when the working height is smaller, an inlet pathway set to a smaller working height may be able to longer avoid potential clogging due to buildup of debris in the trap. In some cases, the inlet pathway may be adjustable prior to fully installing the trap at the HVAC/R system and may be secured in place during installation, such as by a permanent or semi-permanent affixing agent. However, in other cases, the inlet pathway can be adjustable even after being installed at the HVAC/R system and can be temporarily secured in place during installation.

In some cases, the condensate trap can include one or more viewing windows for assessing the condensate level and/or content of the interior reservoir (e.g., presence of debris) from outside the trap without opening the trap. In some cases, some or all of the condensate trap can be made from a transparent or translucent material, thus allowing for inspection of the trap without opening the trap.

In some cases, a removable cover can include any suitable fluid seal capable of being temporarily removed to access the interior reservoir. Examples of suitable covers can include a threaded cap, a threaded plug (e.g., a plug having male threads that thread into a street female adaptor), a bayonet fitting that can be secured in place and twisted to be removed, a hinged fitting that can be latched close, or other such covers. The cover can include gaskets or other features to ensure a fluid seal.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may not be drawn to scale.

FIG. 1 is a schematic diagram depicting a cross-sectional view of a condensate trap 130 as part of an overall HVAC/R drainage system 100 according to certain aspects of the present disclosure. HVAC/R system 110 produces condensate 160 according to the normal operation of the system over time. The condensate 160 can collect at the bottom of HVAC/R system 110 in a drainage pan 102. HVAC/R system 110 can include an outlet 120 (e.g., an outlet pipe or opening in the drainage pan 102) that connects to the condensate inlet 140 of the condensate trap 130. Condensate 160 draining from the drainage pan 102 can travel into the condensate trap 130 at the condensate inlet 140, through the condensate trap 130, and out the condensate outlet 150, after which the condensate 160 can be expelled through a drainage pipe 170 leading to a drain, can be expelled directly into a drain, or can be otherwise disposed.

In some cases, the condensate trap 130 can be removable attached to the HVAC/R system 110 and/or the drainage pipe 170 by couplings 116. The couplings 116 can be any suitable coupling for removably joining two pipes or conduits together, such as a union fitting, a compressible sleeve (e.g., a clampable rubber sleeve), a compression fitting (e.g., a quick-connect fitting or a twist & lock type fitting), or other such fittings. Such coupling hardware (e.g., couplings 116) can allow the condensate trap 130 to be easily removed in its entirety for maintenance, replacement, or other purposes. For example, once the coupling hardware has been installed in the HVAC/R system 110 and/or drainage pipe 170 (e.g., during installation of the HVAC/R system 110 or during previous installation of a condensate trap 130), a homeowner without significant plumbing expertise may be able to easily install or replace a condensate trap 130, without needing to deal with affixing pipes or conduits using advanced techniques such as using adhesives, chemical welding, heat-based welding, brazing, or other techniques. In some case, coupling hardware can be pre-fitted or pre-installed on the condensate trap 130 during manufacturing or prior to installation. In some cases coupling hardware can be provided in a kit with the condensate trap 130 for use or optional use during installation.

FIG. 1 depicts the HVAC/R system 110 in use. As condensate 160 passes through inlet 140 of the condensate trap 130, the condensate 160 fills the internal reservoir of the condensate trap 130 until the level of condensate captured within the internal reservoir (e.g., liquid condensate level) rises above the bottom opening of the condensate inlet 140. The liquid condensate forms a gas seal that prevents air or other gasses from passing between the main body 104 of the condensate trap 130 or the condensate outlet 150 and the condensate inlet 140. As additional condensate 160 is collected within the condensate trap 130, the liquid condensate level can continue to rise until it surpasses the bottom edge of the condensate outlet 150, at which point the condensate 160 can drain out through the condensate outlet 150. Thus, condensate 160 accepted into the condensate trap 130 through the condensate inlet 140 can freely pass through the condensate trap 130 and drain out through the condensate outlet 150 while the volume of condensate 160 entrapped within the condensate trap 130 serves as a gas barrier to keep gas from being pulled up through the condensate inlet 140 and towards the HVAC/R system 110.

Figure 2:
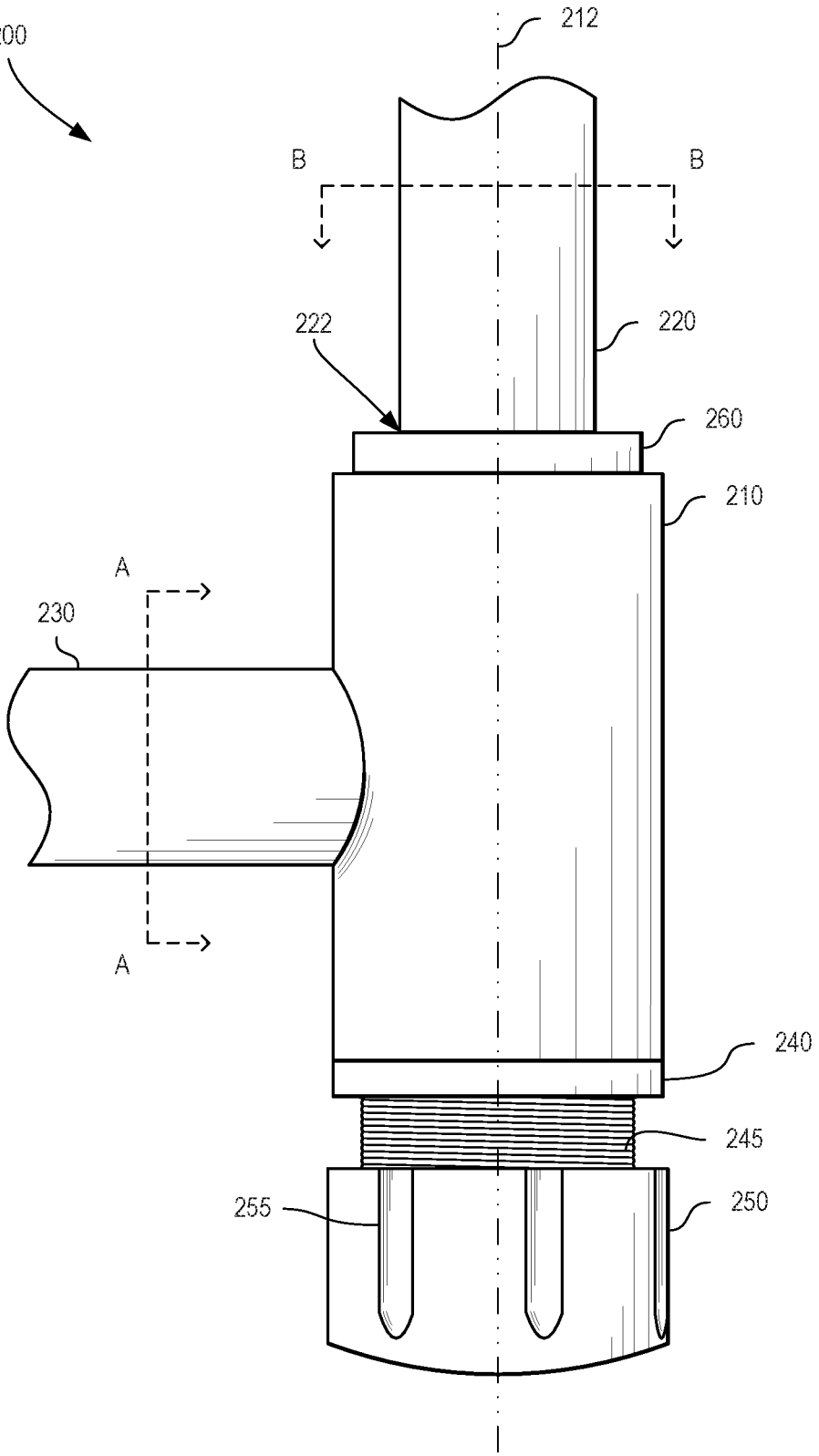
FIG. 2 is a side view depicting a condensate trap according to certain aspects of the present disclosure.

FIG. 2 is a side view depicting a condensate trap 200 according to certain aspects of the present disclosure. Condensate trap 200 can be similar to condensate trap 130 of FIG. 1. Condensate trap 200 can comprise a main body 210, a condensate inlet 222 including an inlet pipe 220 for receiving condensate from an HVAC/R system and directing the condensate into an internal reservoir of the main body 210, and a condensate outlet 230 for draining excess condensate from the internal reservoir of the main body 210. The condensate may pool in the internal reservoir of the condensate trap 200 until the level reaches the condensate outlet 230, at which point excess condensate can flow out of the condensate outlet 230, such as towards a drain. The inlet pipe 220 can be fitted to an upper opening of the main body 210, such as using a reducing bushing 260. Reducing bushing 260 reduces the diameter of the upper opening of body 210 to the diameter of inlet pipe 220. The use of a reducing bushing 260 allows for an inlet pipe 220 having a smaller diameter than the diameter of the main body 210 to be centered along a primary axis 212 (e.g., vertical axis as seen in FIG. 2), thus defining an annular space between the external surface of the inlet pipe 220 and the inner surface of the main body 210. Further, the use of a reducing bushing 260 provides a surface into which vent holes may be optionally placed, as described in further detail herein.

The lower portion of the condensate trap can be fitted with a removable cover 250. In some cases, a street male adapter 240 can be coupled to the main body 210 to provide male threads 245 for engaging female threads of the removable cover 250. In some cases, the removable cover 250 can couple to the main body 210 in other ways, as described below, such as through male threads of the removable cover 250 that engage female threads of the main body 210. The removable cover 250 can include ridges 255 or other features that aid in the application torque during affixing or removal of the removable cover 250. The removable cover 250 can provide a liquid-tight seal when affixed to the street male adapter 240.

In some cases, a removable cover 250 can be coupled to the main body 210 via a street female adapter having threads located on an internal surface of the adapter (e.g., as opposed to the external threading of a street male adaptor). In such embodiments, the removable cover can comprise a male threaded portion on an external surface of the removable cover suitable for engaging the female threaded portion of the street female adapter. In some cases, the removable cover may comprise a bayonet fitting or a hinge fitting that is latched on the opposing side from the hinge. In many cases, optional gaskets, greases, or other features can be used to ensure a liquid-tight seal is established when the removable cover is in a closed position. Other types of removable covers may be used to provide a liquid-tight seal while enabling easy removal to access the internal reservoir of the main body 210. Removable covers can be fully removed (e.g., separated from the main body 210) or partially removed (e.g., opened sufficiently to access the internal reservoir of the main body 210, but still coupled to the main body 210 in some fashion).

A removable cover can advantageously improve the longevity and efficiency of the condensate trap. Over time, the standing condensate in a condensate trap can cause a buildup of various bacteria, algae, and/or fungus that can block the passage of liquid through the trap, as well as any collected debris that becomes entrained in the condensate flow into the condensate trap. Once the trap becomes blocked, condensate may not be able to reach a proper drainage location and condensate can back up into the HVAC/R system and potentially cause costly or dangerous damage to the HVAC/R system or the surrounding environment. Removable cover 250 can be removed or opened to provide access to the internal reservoir of the condensate trap to enable inspection and/or cleaning of the trap, including the removal of any blockages or debris, as well as any currently trapped condensate. The orientation of the inlet pipe 220 and the removable cover 250, such as collinear along axis 212, can further allow a user to inspect and clean the inlet pipe 220 when the removable cover 250 is opened or removed.

Figure 3:
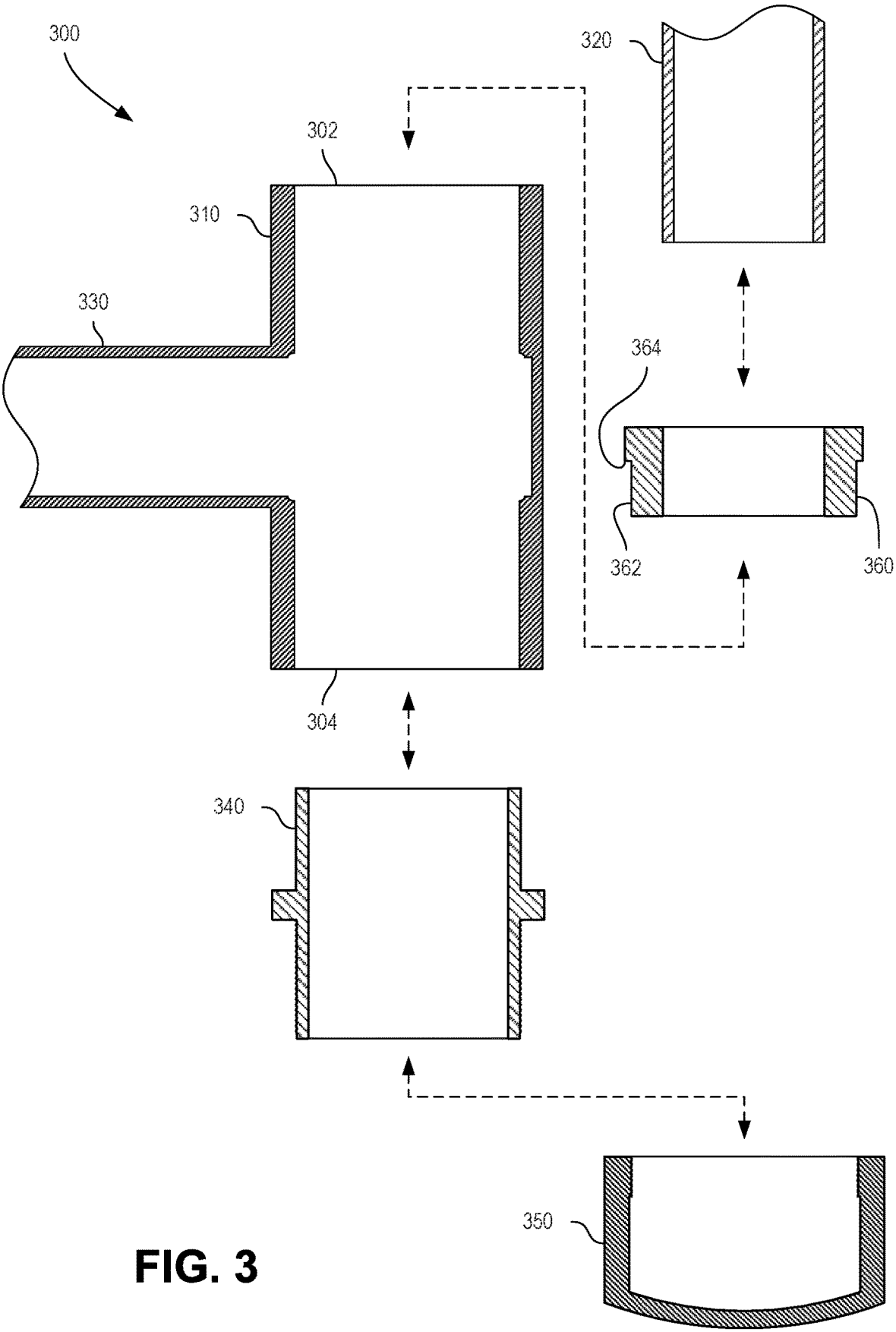
FIG. 3 is a cross-sectional exploded view depicting various parts of a condensate trap according to certain aspects of the present disclosure.

FIG. 3 is a cross-sectional exploded view depicting various parts of a condensate trap 300 according to certain aspects of the present disclosure. In some cases, a condensate trap can comprise five major parts: a reducing tee fitting 310, an inlet pipe 320, a reducing bushing 360, a street male adapter 340, and a removable cover 350. While at least some of these parts may be known plumbing parts, they have been modified and/or assembled in a unique fashion to assemble the completed condensate trap 300. For example, reducing bushing 360 has been modified in a non-standard fashion, counter to its intended use, to allow the inlet pipe 320 to extend sufficiently into the main body of the reducing tee fitting 310.

Reducing tee fitting 310 can include two concentric, spaced-apart openings 302 and 304 and an outlet 330, having a smaller diameter than openings 302 and 304, that is perpendicular to and located between openings 302 and 304. Outlet 330 can be approximately equally spaced apart from openings 302 and 304 or can be closer to one opening than the other.

The reducing bushing 360 can help retain the inlet pipe 320 in position within opening 302. An external diameter 362 of the reducing bushing 360 can fit within the internal diameter of opening 302, optionally allowing a lip 364 of the reducing bushing 360 to rest upon the top edge of opening 302. The reducing bushing 360 can be a non-standard bushing or can be a modified reducing bushing. For example, a standard reducing bushing may include an internal shelf or shoulder against which a pipe placed within the internal diameter of the reducing bushing may be placed in normal use. This internal shelf ensures the pipe cannot extend into whatever piece the reducing bushing has been inserted. Reducing bushing 360 may be a standard reducing bushing that has been modified to remove this internal shelf, thus allowing the inlet pipe 320 to extend past the length of the reducing bushing 360 and into the main body of the reducing tee fitting 310. This modification renders the standard reducing bushing unsuitable for its intended purpose.

Street male adapter 340 can be affixed to the lower opening 304. Street male adapter 340 can extend beyond opening 304 to receive removable cover 350. Removable cover 350 can be affixed to street male adapter 340 using corresponding threads that allow removable cover 350 to provide a liquid tight seal while providing on-demand access to the internal cavity of reducing tee fitting 310 when desired.

The reducing tee fitting, inlet pipe, reducing bushing, street male adapter, and removable cover can be specially manufactured or can be modified from readily accessible parts, such as those generally available at any hardware store. In some cases, various parts may be manufactured or special ordered to comprise two or more of the above identified parts as a single, monolithic part. In some cases, the condensate trap can be monolithic (e.g., made from a single part or piece). In some cases, any parts of the condensate trap that are joined together can be secured together with fluid-tight seals, such as through the use of PVC cement, affixing agents, pipe tape, gaskets, welding, brazing, or other such seals and techniques. The reducing tee fitting, inlet pipe, reducing bushing, street male adapter, and removable cover, as well as other relevant hardware, may be manufactured from one or a combination of PVC, transparent PVC, chlorinated polyvinyl chloride (CPVC), galvanized steel, iron, copper, brass, or any suitable material. In some cases, each, all, or any combination of the reducing tee fitting, inlet pipe, reducing bushing, street male adapter, and/or removable cover may be made from different materials. Options for affixing various parts together, as described throughout, can depend on the type of materials being affixed together. For example, when copper or brass is used for two parts being fixed together, a heat-based welding or brazing process may be used to affix the parts together instead of an affixing agent.

Figure 4:
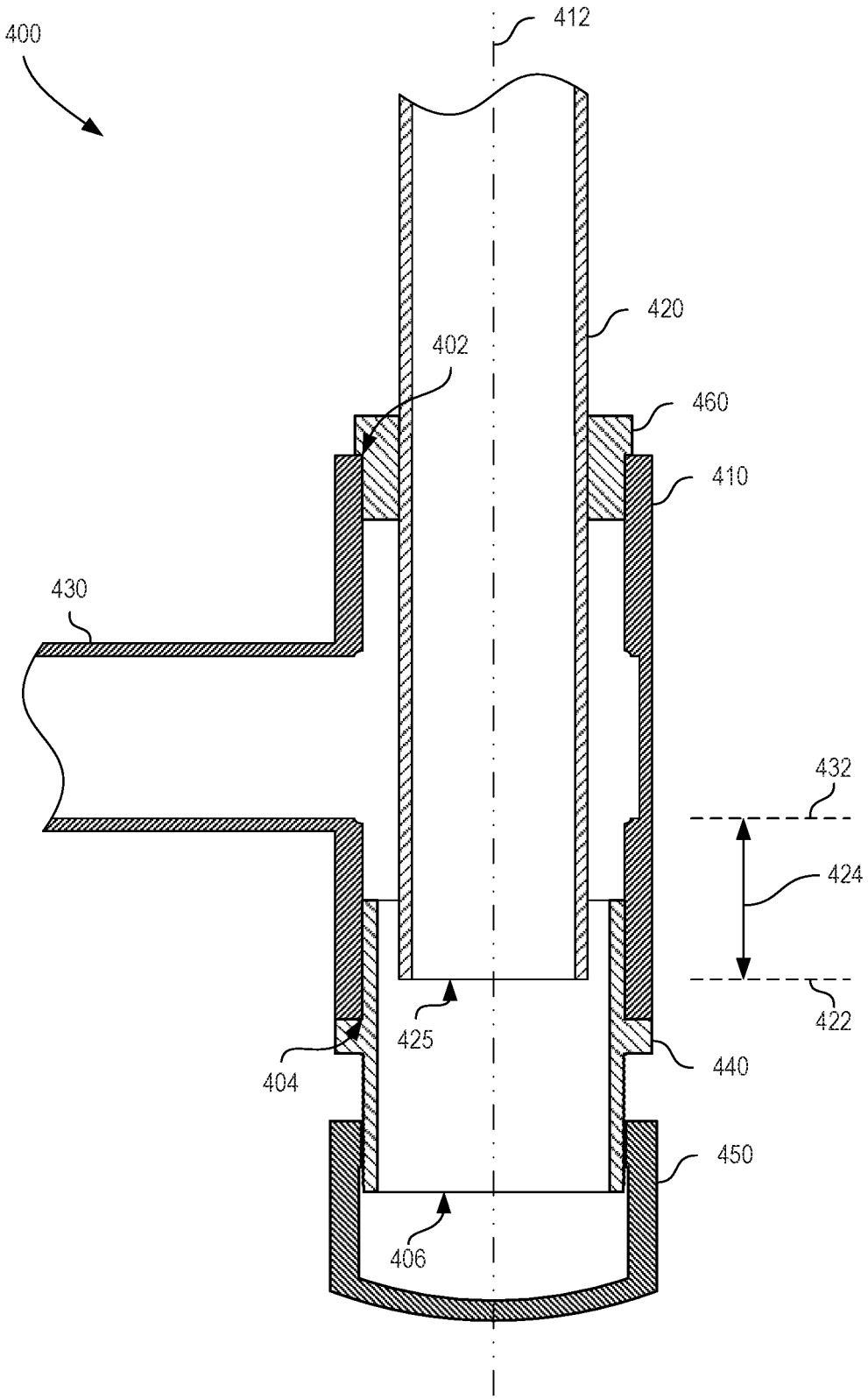
FIG. 4 is a cross-sectional view depicting a condensate trap according to certain aspects of the present disclosure.

FIG. 4 is a cross-sectional view depicting a condensate trap 400 according to certain aspects of the present disclosure. Condensate trap 400 can be similar to condensate traps 200 or 300 of FIGS. 2-3. The main body of the trap can be made from a reducing tee fitting 410. Reducing tee fitting 410 can include an upper opening 402 and a lower opening 404 that are concentric with a primary axis 412 of the reducing tee fitting 410. The upper opening 402 and lower opening 404 can have the same or different diameters. Reducing tee fitting 410 can additionally include a side outlet 430 located between the upper opening 402 and lower opening 404 and extending in a direction perpendicular to the primary axis 412 of the reducing tee fitting 410. The side outlet 430 can have a smaller diameter than openings 402 and 404, although in some cases the diameter of the side outlet 430 can be the same or larger than the diameter of openings 402 and 404. In some cases, openings 402 and 404 have a diameter of approximately 1.4 inches and outlet 430 has a diameter of approximately 0.75 inches. In some cases, opening 402 and 404 each have a diameter of approximately 1.5 inches and outlet 430 has a diameter of approximately 0.75 inches. Other sizes of openings, including larger or smaller than disclosed above, maybe used. In some cases, openings 402 and 404 are of equal diameter and outlet 430 is of a smaller diameter than openings 402 and 404. The diameters provided above can be inner diameters or outer diameters, as appropriate.

The lower opening 404 of reducing tee fitting 410 can be fitted with a street male adapter having a lower opening 406. The inlet pipe 420 can have a diameter that is smaller than opening 402. A reducing bushing 460 can be fitted to upper opening 404 of reducing tee fitting 410 to create a gap between the internal surface of the reducing tee fitting 410 and the internal surface of the reducing bushing 460. This gap provides an annulus between the external surface of an inlet pipe 420 fitted within the reducing bushing 460 and the internal surface of the reducing tee fitting 410. This gap can also provide space for one or more vents, as described in further detail below. When assembled, the lower opening 425 of the inlet pipe 420 can be located within the reducing tee fitting 410, such as below the outlet 430 of the reducing tee fitting 410. The inlet pipe 420 can function to form an inlet pathway into the reducing tee fitting 410 (e.g., main body) of the trap 400.

In some cases, the depth of the lower opening 425 of inlet pipe 420 is fixed. The depth of the lower opening 425 of the inlet pipe 420 can be fixed due to the inlet pipe 420 being fixed to the reducing bushing 460, such as by PVC cement or other suitable affixing agents. However, in some cases, the depth of lower opening 425 of inlet pipe 420 can be variable, such as through the use of an inlet pipe 420 having an adjustable length or through the use of a non-permanent coupling between the inlet pipe 420 and the reducing bushing 460 such that the inlet pipe 420 can be axially displaced with respect to the reducing bushing 460 to a desired location prior to axially securing the inlet pipe 420 to the reducing bushing 460. The depth of the lower opening 425 can be selected based on the measured or expected amount of negative pressure generated by the HVAC/R system. In some cases, an automatically adjustable inlet pipe 420 can be used that adjusts its depth based on the measured negative pressure generated by the HVAC/R system.

The lower opening 425 can define an inlet level 422. The outlet 430 can define an outlet level 432 based on the portion of outlet 430 that is closest to lower opening 404 (e.g., the portion of outlet 430 that is nearest the bottom of the trap 400 when installed). When installed properly, the inlet level 422 is located below the outlet level 432, defining a trap height 424. In other words, the outlet 430, and more specifically the bottom of the outlet 430, is vertically spaced apart from the inlet opening 425 by a distance. When the trap is properly installed and the removable cap 450 is closed, liquid can collect in the trap 400 up to the outlet level 432. Any additional liquid can be expelled through outlet 430 due to natural gravitational flow. The liquid present in the trap 400 between the inlet level 422 and outlet level 432, also known as the liquid within the trap height 424, can establish the gas seal.

The preferred depth of the lower opening 425, whether fixed or variable, can be dictated by the negative pressure loads experienced by the condensate trap. If the depth of the lower opening 425 is too close to lower opening 406, the condensate trap 400 may not drain efficiently and may be prone to clogging. If the depth of the lower opening 425 is too high, the trap height 424 may be small enough to allow the gas seal to break with small amounts of negative pressure. For example, when the trap height 424 is too small, the negative pressure from the HVAC/R system may be sufficiently powerful to pull the liquid within the trap height 424 up the inlet pipe 420 and allow gases (e.g., air) to be inhaled from through the inlet pipe 420. The lower opening 425 may be located at higher or lower depths to decrease or increase the amount of negative pressure load the trap can withstand while maintaining a gas seal, respectively. A desirable location of the lower opening 425, and thus the inlet level 422, can be at or approximately halfway between the outlet level 432 and opening 406, or within 5%, 10%, 15%, 20%, or 25% of that location. In some cases, a desirable location of the inlet level 422 can be at or approximately halfway between lower the outlet level 432 and opening 404, or within 5%, 10%, 15%, 20%, or 25% of that location.

Lower opening 406 created by street male adapter 440 can receive the removable cover 450. The external portion of street male adapter can comprise a male threaded portion that engages the female threaded portion of removable cover 450, enabling the removable cover 450 to provide a liquid-tight seal over opening 406 (e.g., an access port). Removable cover 450 may be advantageously removed, rendering access to the internal reservoir of condensate trap 400 for cleaning and maintenance.

Figure 5:
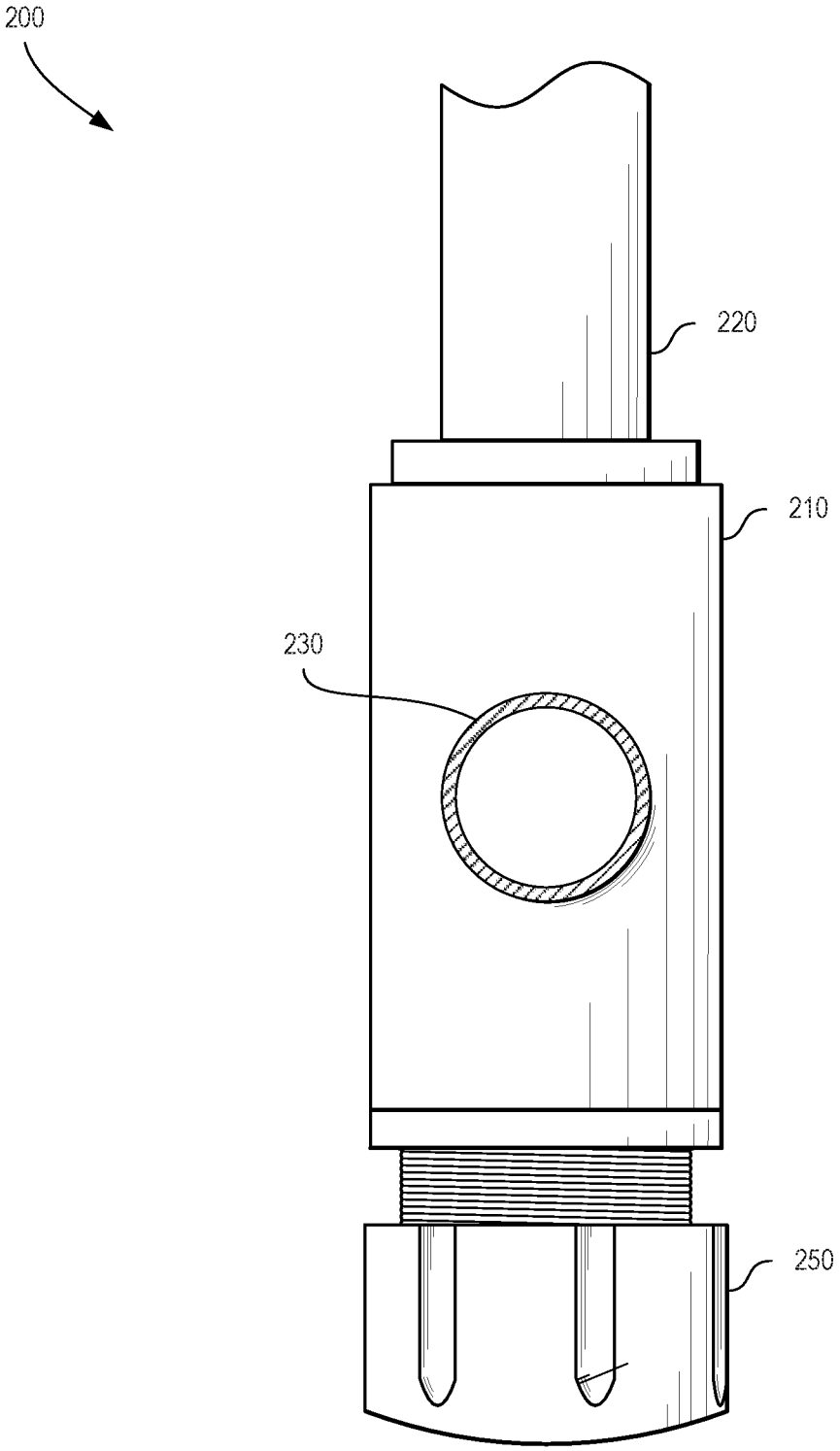
FIG. 5 is a front view depicting the condensate trap of FIG. 2 taken from line A:A of FIG. 2, according to certain aspects of the present disclosure.

FIG. 5 is a front view depicting the condensate trap 200 of FIG. 2 taken from line A:A of FIG. 2, according to certain aspects of the present disclosure. Condensate trap 200 may comprise a main body 210, an inlet pipe 220, a removable cover 250, and an outlet 230.

Figure 6:
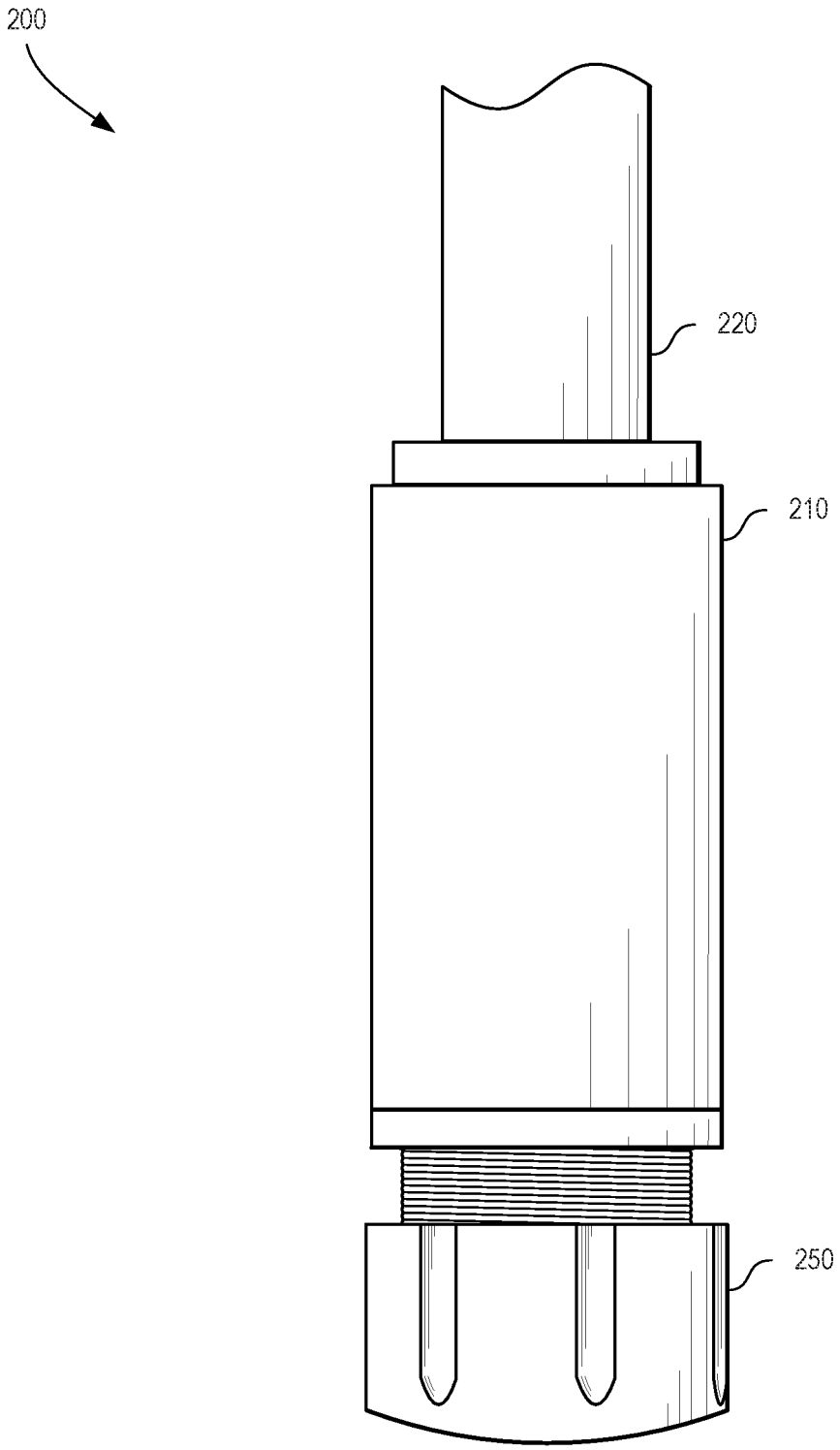
FIG. 6 is a rear view of the condensate trap of FIG. 2, taken from opposite the condensate trap from line A:A of FIG. 2, according to certain aspects of the present disclosure.

FIG. 6 is a rear view of the condensate trap 200 of FIG. 2, taken from opposite the condensate trap from line A:A of FIG. 2, according to certain aspects of the present disclosure. Condensate trap 200 may comprise a main body 210, an inlet pipe 220, a removable cover 250, and an outlet 230.

Figure 7:
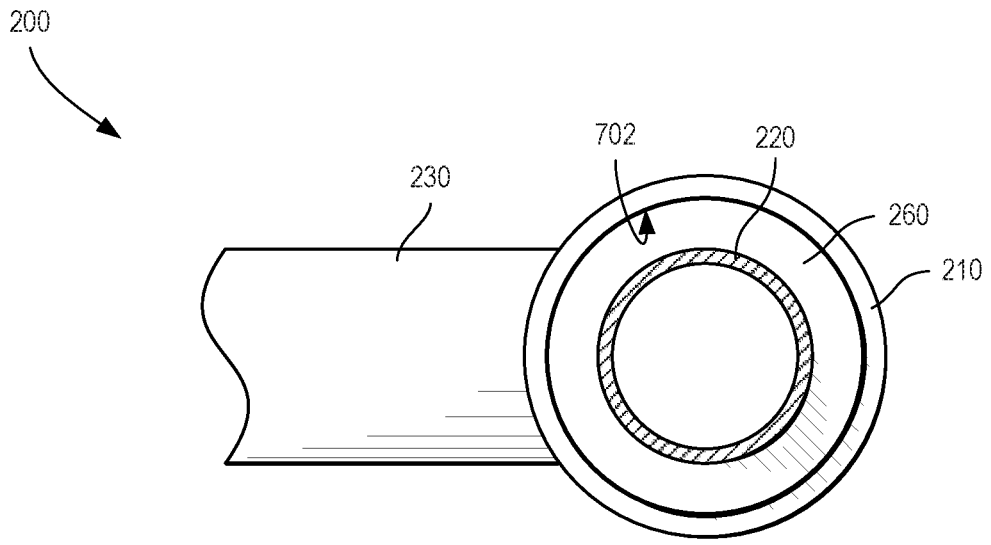
FIG. 7 is a cross-sectional top view of the condensate trap of FIG. 2 taken from line B:B of FIG. 2, according to certain aspects of the present disclosure.

FIG. 7 is a cross-sectional top view of the condensate trap 200 of FIG. 2 taken from line B:B of FIG. 2, according to certain aspects of the present disclosure. Condensate trap 200 may include a main body 210, an inlet pipe 220, and an outlet 230. A reducing bushing 260 can allow the inlet pipe 220 to remain centered within the upper opening 702 such that the external diameter of the inlet pipe 220 is spaced apart from an internal diameter of the upper opening 702. The volume defined by the internal wall of the main body 210 (e.g., approximately the internal diameter of the upper opening 702), the external diameter of the inlet pipe 220, the bottom end of the inlet pipe 220 (e.g., the inlet level 422 of FIG. 4), and the bottom portion of the outlet 230 (e.g., the outlet level 432 of FIG. 4) can contain the volume of trap liquid that forms the gas seal.

Figure 8:
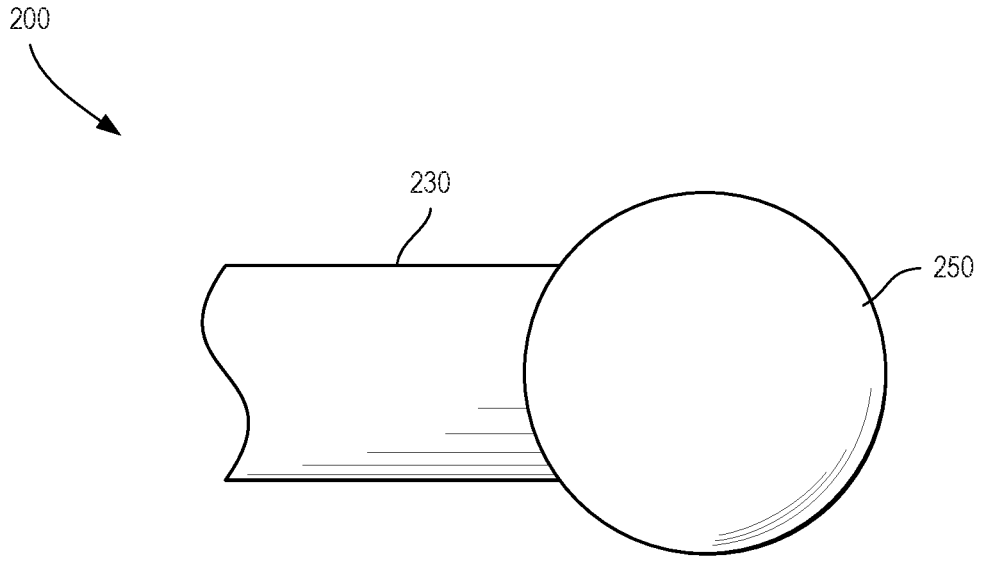
FIG. 8 is a bottom view of the condensate trap of FIG. 2 taken from opposite the trap from line B:B of FIG. 2, according to certain aspects of the present disclosure.

FIG. 8 is a bottom view of the condensate trap 200 of FIG. 2 taken from opposite the trap 200 from line B:B of FIG. 2, according to certain aspects of the present disclosure. From the bottom, the outlet 230 and removable cover 250 of the trap 200 are visible.

Figure 9:
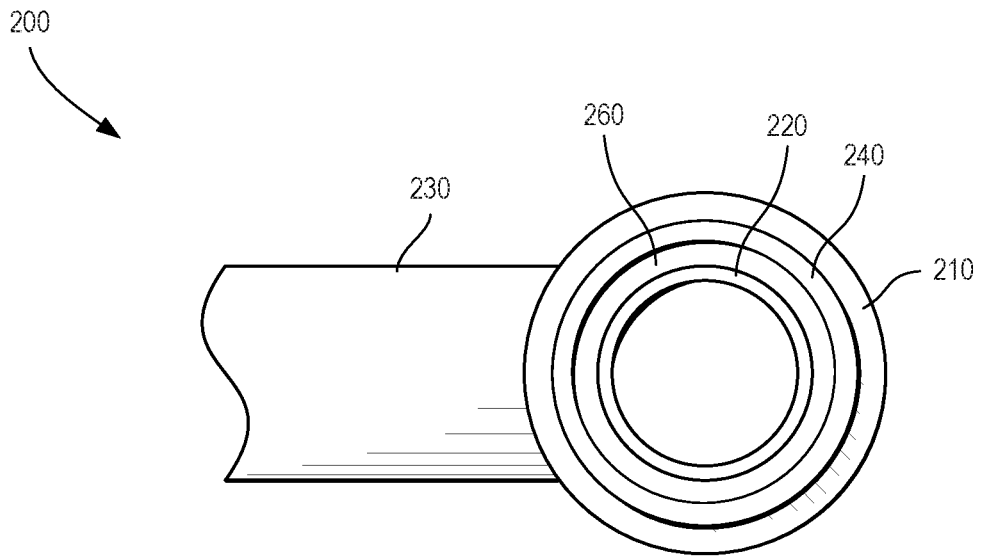
FIG. 9 is a bottom view of the condensate trap of FIG. 2 similar to the view of FIG. 8, but with the removable cover removed, according to certain aspects of the present disclosure.

FIG. 9 is a bottom view of the condensate trap 200 of FIG. 2 similar to the view of FIG. 8, but with the removable cover 250 removed, according to certain aspects of the present disclosure. The bottom view shows the same outlet 230, however now the main body 210, street male adaptor 240, and inlet pipe 220 are visible. Also visible is the reducing bushing 260 located near the top (e.g., the top as seen in FIG. 2) of the device, through which the inlet pipe 220 is passed and by which the inlet pipe 220 is secured with respect to the main body 210.

The removable cover can removably couple to the street male adaptor 240 to provide access to the inside of the main body 210. Any debris or build-up within the trap 200 can be removed or cleared out by opening or removing the removable cover and either letting the debris and build-up fall out of the main body 210 via gravity or through active cleaning of the inside of the main body 210. Further, removal of the removable cover can allow for visual inspection of the inside of the trap 200, as seen in FIG. 9, such as to ensure the trap 200 is properly assembled or to check for blockages, debris, or build-up within the main body 210. The inner diameter of the main body 210, or inner diameter of the street male adaptor 240 if one is used, can be sufficiently large to allow access to the interior of the main body 210 for visual inspection and/or cleaning. Further, that inner diameter can be sufficiently large as to avoid blockage of any debris between that inner diameter and the inlet pipe 220. In some cases, access through this bottom opening of the condensate trap 200 can facilitate initial assembly and/or continued maintenance.

In an example, the condensate trap 200 can be assembled such that the inlet pipe 220 is secured in place to the reducing bushing 260 after having been passed through the opening in the reducing bushing 260 in a direction from the bottom to the top (e.g., from the bottom as depicted from FIG. 2 to the top). The direction of installation of the inlet pipe 220 can be important to ensure a good seal is maintained between the inlet pipe 220 and the reducing bushing 260. Further, the inlet pipe 220 may be installed by initially applying affixing agent (e.g., glue or PVC cement) to a portion of the external wall of the inlet pipe 220 and sliding the inlet pipe 220 up through the reducing bushing 260 in the direction described above. By applying the affixing agent to the inlet pipe 220 instead of the reducing bushing 260, the end of the inlet pipe 220 that will be used to connect to the HVAC/R system can remain free clean and from affixing agent, which can allow for easier and/or otherwise improved installation of an assembled condensate trap 200 to the HVAC/R system. If affixing agent is not properly applied during assembly of the condensate trap 200 or if the inlet pipe 220 is assembled in a wrong direction, the condensate trap 200 or its connection to the HVAC/R system may leak or allow air to be inhaled into the HVAC/R system. The opening in the bottom of the trap 200, as seen in FIG. 9, can facilitate assembly of the trap 200 by providing sufficient access to the interior of the main body 210 such that an inlet pipe 220 with affixing agent applied thereon can be inserted through the reducing bushing 260 in the proper direction. Without a sufficient opening, the inlet pipe 220 may need to be installed from the top down, which may result in affixing agent coating the bottom end of the inlet pipe 220 and/or affixing agent spilling out over the top of the reducing bushing 260, which can clog other openings (e.g., vents, as described in further detail herein) or otherwise make a mess. In some cases, the inlet pipe 220 can be assembled onto the reducing bushing 260 prior to the reducing bushing 260 being assembled onto the main body 210. However, it may be desirable to assemble the inlet pipe 220 after the reducing bushing 260 has been assembled onto the main body 210, at least to allow for accurate adjustment of the bottom of the inlet pipe 220, and thus the inlet level (e.g., inlet level 422 of FIG. 4) during assembly and/or at the site of the HVAC/R system (e.g., after determining the amount of inhalation power needed to be overcome by the trap, and thus the necessary trap height (e.g., trap height 424 of FIG. 4). Further, in some cases, a monolithic main body may resemble the size and/or shape of a main body 210 and a reducing bushing 260 without the need for a separate reducing bushing, and therefore there may be no ability to install the inlet pipe 220 prior to installing a reducing bushing to a main body, and thus the inlet pipe 220 must be installed either from below (e.g., through the opening at the bottom of the trap) or from above (e.g., using a potentially undesirable assembly technique).

Figure 10:
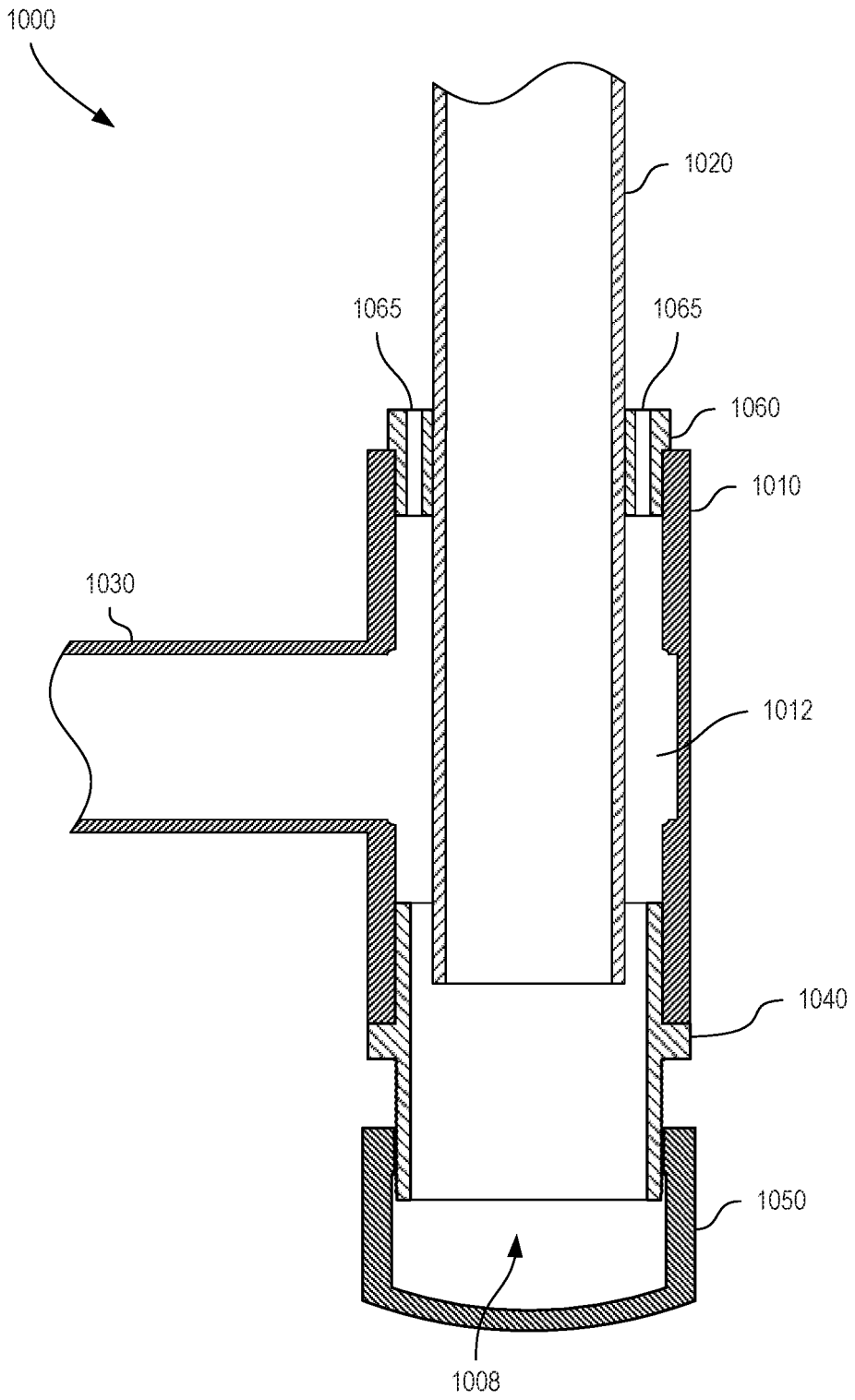
FIG. 10 is a cross-sectional view depicting a condensate trap with vent holes according to certain aspects of the present disclosure.

FIG. 10 is a cross-sectional view depicting a condensate trap 1000 according to certain aspects of the present disclosure. Condensate trap 1000 can include a main body 1010 (e.g., a hollow cylindrical body), an inlet 1020 (e.g., an inlet pipe or opening), an outlet 1030 (e.g., an outlet pipe or opening), and a removable cover 1050. The trap 1000 depicted in FIG. 10 is shown in an in-use orientation, with the inlet 1020 extending in an upwards direction (e.g., against gravity), the removable cover 1050 located at the bottom of the main body 1010, and the outlet 1030 exiting out of the side of the main body 1010. The outlet 1030 can exit out in a direction that is perpendicular to the inlet 1020. While the removable cover 1050 is generally located at the bottom of the main body 1010, in some cases, the removable cover 1050 can open or be removed to expose an access port 1008 facing downwards or sideways from the main body 1010. The inlet 1020 can form an inlet pathway into the main body 1010 of the trap 1000 for fluid transport, such as transport of condensate into the trap 1000. The inlet pathway can be that portion of the inlet 1020 located within the main body 1010 and/or bushing 1060 of the trap 1000.

As seen in FIG. 10, trap 1000 includes a reducing bushing 1060 securing the inlet 1020 with respect to the main body 1010, although other parts and/or a differently shaped main body 1010 could instead secure the inlet 1020 with respect to the main body 1010. In some cases, the main body itself can be monolithically shaped to incorporate a reducing bushing as described above.

As seen in FIG. 10, trap 1000 includes an adaptor 1040 that is secured to the main body 1010 and allows the removable cover 1050 to be removably coupled to the main body 1050, thus allowing the removable cover 1050 to selectively seal or provide access to the access port 1008. The adaptor 1040 depicted in FIG. 10 includes threads that engage threads of the removable cover 1050, although different adaptors 1040 can be used that facilitate the removable cover 1050 in selectively sealing or providing access to the access port 1008. In some cases, the removable cover 1050 can affix to adapter 1040 by a hinge with a clasp on the opposing side, optionally with a gasket to facilitate the liquid seal. In some cases, the removable cover 1050 can affix to adapter 1040 via a bayonet fitting, optionally with a gasket. Other attachment mechanisms can be used to removably couple the removable cover 1050 to the main body 1010 or the adaptor 1040. In some cases, the main body itself can be monolithically shaped to incorporate an adaptor as described above.

As seen in FIG. 10, the inlet 1020 can extend above the main body 1010 and down into the main body 1010, specifically past the outlet 1030. The inlet 1020 depicted in FIG. 10 is a single pipe that extends from inside the main body 1010 to outside the main body 1010, facilitating coupling to an HVAC/R system. In some cases, the inlet 1020 can include an internal portion that extends into the main body 1010 similarly to as seen in FIG. 10, but may include a smaller pipe, an opening, or any suitable adaptor at the surface of or exterior to the main body 1010 to facilitate another pipe or adaptor being secured thereto for coupling to an HVAC/R system. For example, an inlet of a condensation trap may include a female adaptor suitable for receiving a pipe or piece of tubing. In some cases, the main body itself can be monolithically shaped to incorporate an inlet as described above.

In some cases, a condensate trap 1000 can include one or more vent holes 1065 to expose the internal cavity 1012 of the condensate trap to the air outside the Condensate trap to avoid air lock. The vent holes 1065 are located opposite the gas seal (e.g., surface of liquid entrapped within the trap 1000) from the inlet 1020. Vents 1065 can facilitate drainage of fluid out through the outlet 1030. In some cases, a vacuum effect can prevent liquid from flowing through the outlet 1030 and any enclosed paths between the outlet 1030 and the final drain. Vents 1065 can let air in, allowing the air to displace the liquid that is flowing out of the outlet 1030, thus avoiding an internal vacuum and facilitating fluid flow. In some cases, a vacuum relief valve can be used in place of a vent 1065.

In some cases, one or more vents 1065 are located in the reducing bushing 1060. Vents 1065 can be of any suitable size or shape, such as circular or non-circular. Vents 1065 can extend vertically through the reducing bushing in a direct or tortuous path. In some cases, vents 1065 can be located in the main body 1010, such as through a top or side wall of the main body 1010. Vents 1065 can generally be located anywhere in the main body 1010 and/or reducing bushing 1060 that is above the outlet 1030. In some cases, vents 1065 can be located on the outlet 1030. It is noted that vents 1065 are not located in the inlet 1020 or anywhere that would allow an HVAC/R system coupled to the inlet 1020 to inhale air without overcoming the gas seal created by the entrapped liquid within the trap 1000.

Figure 11:
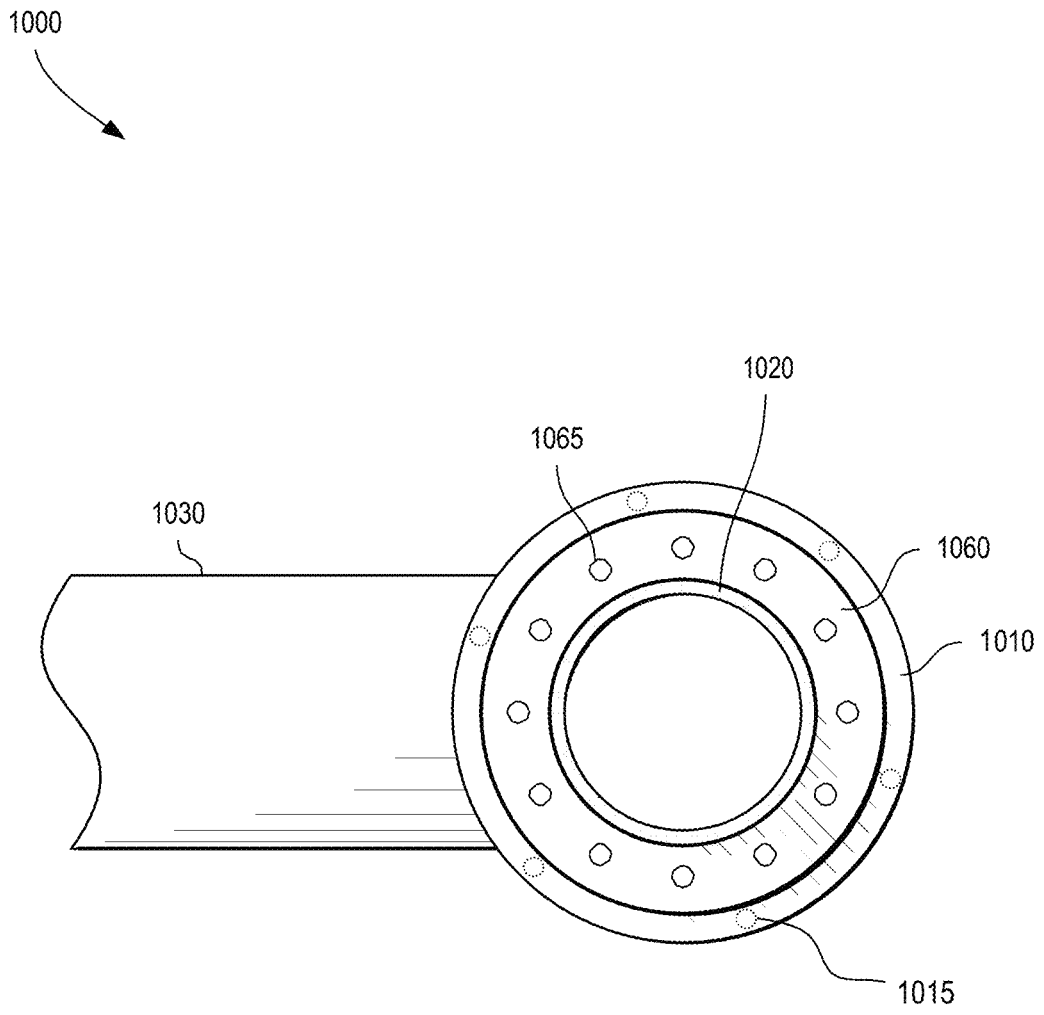
FIG. 11 is a top view of the trap of FIG. 10 according to certain aspects of the present disclosure.

In some cases, vent precursors 1015 can be used instead of vents 1065. A vent precursor 1015 can be an indication of a location where a vent 1065 can be created (e.g., through drilling the main body 1010 or reducing bushing 1060) upon installation of the condensate trap 1000. Such indications can be shown as ink, engravings, or other visual or tactile markings on the surface of the trap 1000, as illustrated in FIG. 11. In some cases, a vent precursor 1015 can be a pre-drilled portion of the trap 1000 that does not fully penetrate the main body 1010 or reducing bushing 1060 sufficiently to allow fluid flow therethrough. This vent precursor 1015 can be converted into a vent 1065 through drilling (e.g., with a power drill), puncture (e.g., with a standard screwdriver), or other physical interactions. In some cases, a vent precursor 1015 can include a vent 1065 that is sealed with a removable cover, which can be removed to expose the vent 1065. A removable cover can be coupled to the trap 1000 in any suitable way, including through affixing agents, mechanical couplings, or otherwise. In some cases, the removable cover is a portion of the trap 1000 that has been designed to be easily removed, such as through scoring or other preparations. In some cases, multiple vent precursors 1015 can be present on a trap 1000, allowing an installer to select one, some, or all of the vent precursors 1015 for use as vent(s) 1065.

Vents 1065 can provide an additional advantage of enabling quick diagnosis of clogs or other overflow conditions in the trap 1000. For example, if liquid is observed exiting through a vent 1065, it can be assumed that the trap 1000 is not sufficiently draining, which can be due to clogging or improper sizing of the trap 1000. Thus, the vents 1065 can act as an external, visual indicator for a potential need for maintenance (e.g., cleaning) of the trap 1000. Further, indications of fluid on or near the trap 1000 or on a surface (e.g., floor) below the trap 1000 can be an indication that liquid leaked out of the vent 1065 at an earlier time.

FIG. 11 is a top view of the trap 1000 of FIG. 10 according to certain aspects of the present disclosure. Condensate enters the main body 1010 through inlet 1020 and exits through the outlet 1030. Vents 1065 are seen in the reducing bushing 1060 to facilitate drainage of the liquid through the outlet 1030. The vents 1065 depicted in FIG. 11 are shown in a constant-radius symmetric pattern around the top surface of the reducing bushing 1060, however other patterns and distributions can be used. As described above, vents 1065 may be located in other parts of the trap 1000, including the main body 1010. Vents 1065 may be separated by a uniform distance between each to maximize the effectiveness of the vents. While FIG. 11 depicts twelve vent holes, any number of vent holes may be used.

Figure 12:
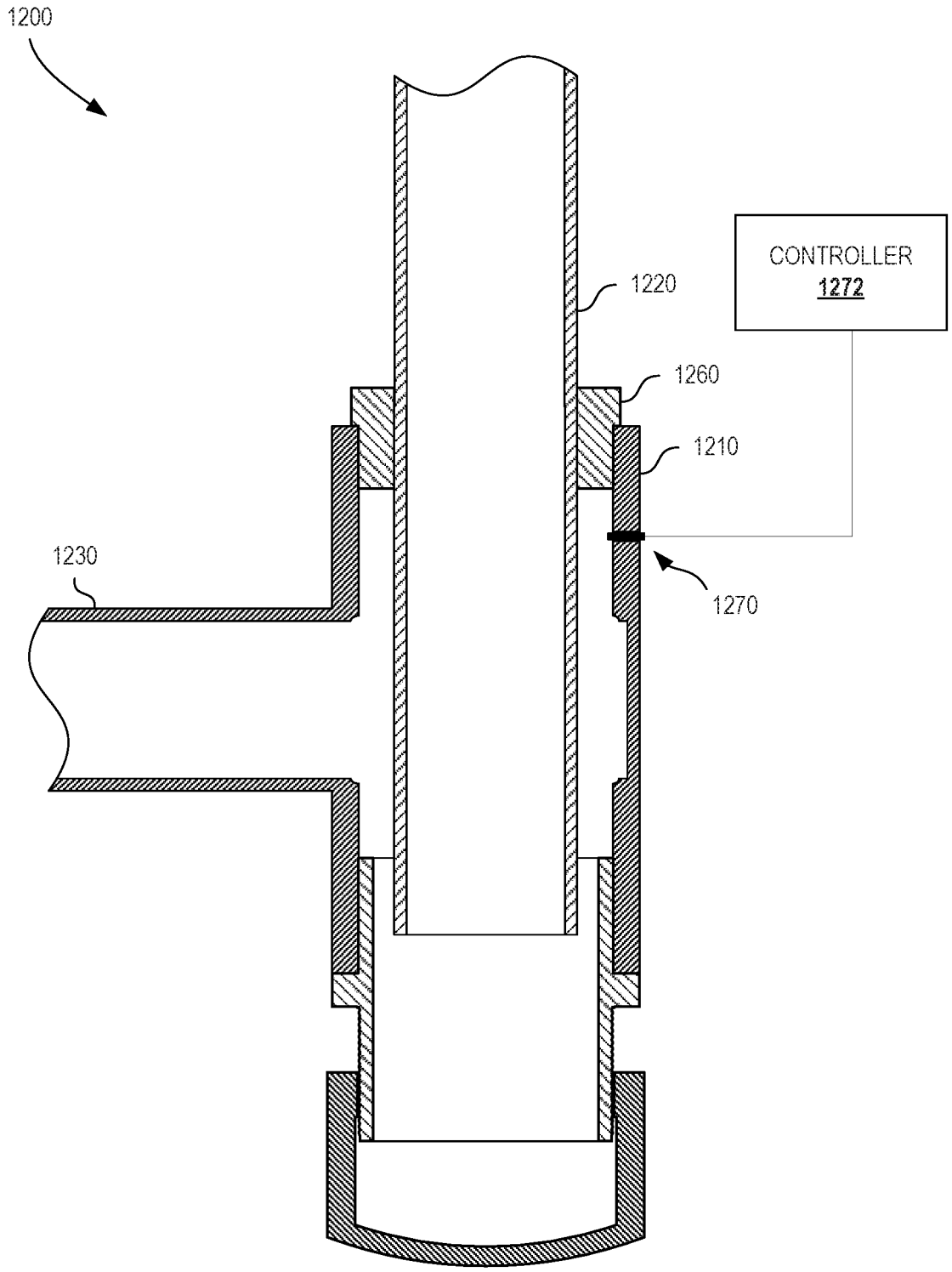
FIG. 12 is a cross-sectional view depicting a condensate trap with a liquid level sensor according to certain aspects of the present disclosure.

FIG. 12 is a cross-sectional view depicting a condensate trap 1200 with a liquid level sensor 1270 according to certain aspects of the present disclosure. The condensate trap 1200 can be any suitable condensate trap, such as those referenced with respect to FIGS. 1-11. The use of a sensor 1270 (e.g., a liquid level sensor) can protect an environment and/or an HVAC/R system by providing warning or performing other actions when it is determined that condensate is not sufficiently draining from the condensate trap 1200, such as due to blockage, clogging, or an insufficiently sized trap 1200. Condensate trap 1200 advantageously alleviates the risk of damage from malfunctions that occur in the drainage system using sensor 1270.

Any suitable sensor 1270 can be used that can register a signal when the liquid level in the main body 1210 of the trap 1200 exceeds a threshold. Suitable sensors 1270 include liquid contact sensors designed to close a connection upon physical contact with liquid, pressure sensors, optical sensors, or any other such sensor. The sensor 1270, and/or the signal it produces, can be electrical or mechanical in nature. The sensor 1270 may be located at various locations within the trap 1200, such as on, within, or through the wall of the main body 1210, the outlet 1230, or the reducing bushing 1260. As seen in FIG. 12, a sensor 1270 is located through the wall of the main body 1210 at a position between the outlet 1230 and the reducing bushing 1260. The sensor 1270 can provide different functionality depending on the selected location of the sensor 1270. For example, sensor 1270 can be located in-line with the outlet 1230, thus providing a signal whenever condensate is flowing through the outlet 1230 (e.g., when the HVAC/R system is producing condensate). In some cases, sensor 1270 may be located between outlet 1230 and reducing bushing 1260, thus providing a signal whenever condensate is accumulating faster than it is draining through the outlet 1230. A signal from such a sensor 1270 can be associated with a partial or complete blockage, such as a partial or complete blockage in the outlet 1230 or somewhere in the line between the outlet 1230 and the drain. The report of liquid when the condensate trap 1200 is almost full rather than completely full can advantageously allow an interested person to identify and resolve a potential problem well before the condensate begins to backup into the HVAC/R unit or before condensate leaks into the environment, such as on a floor or on nearby equipment. In some cases, a sensor 1270 may be located at the top of the condensate trap 1200, such as in or near a vent (e.g., vent 1065 of FIG. 10) in reducing bushing 1260. At such a location, a signal from the sensor 1270 can be associated with the trap 1200 no longer being operational and requiring immediate maintenance.

Sensor 1270 can provide a signal to a controller 1272. The signal can be reported in real time. The controller 1272 can be any suitable processor or processing equipment capable of receiving a signal from sensor 1270 and performing some or all of the tasks described with reference to controller 1272. Controller 1272 can include non-transitory machine readable memory containing instructions for performing any of the tasks described with reference to controller 1272. Controller 1272 can include one or more processors located in a single or multiple housings. Controller 1272 can be coupled to condensate trap 1200 or can be located near condensate trap 1200. Sensor 1270 can be coupled to controller 1272 via wired or wireless connection. In some cases, the signal from sensor 1270 can be associated with the presence or absence of water at or above a predetermined setpoint within the trap 1200. In some cases, the signal from sensor 1270 can be associated with a measurement of the level of the liquid within the trap 1200, such as a percent full or a distance of the surface of the liquid within the trap 1200 with respect to the sensor 1270 or a surface of the trap 1200.

In some cases, controller 1272 can report the liquid level (e.g., presence of liquid and/or a measured liquid level) to an attached or nearby user interface. Examples of suitable user interfaces include lights, light emitting diodes, liquid crystal displays, or any other suitable display. In some cases, controller 1272 can report the liquid level to a remote device, such as a wireless display or a networked device (e.g., a device accessible through a local or wide area network, such as the internet). Controller 1272 can include any suitable radio or network interface, as necessary. For example, controller 1272 may provide a report to a smartphone connected through a Bluetooth connection, another controller connected through a z-wave connection, a smartphone connected to a local area network, or a smartphone connected via the Internet. In some cases, controller 1272 can provide a report to a remote server, which can store the report for future retrieval and/or relay the report to a receiving device.

In some cases, the controller 1272 can provide a control signal to another piece of equipment upon receiving an indication that the liquid level has surpassed a setpoint (e.g., as defined by the placement of the sensor 1270 or as defined by the controller). For example, in some cases, controller 1272 can provide a signal to an HVAC/R system to power down so as to prevent more condensate from entering the trap 1200.

In some cases, controller 1272 can provide a warning to a homeowner, renter, HVAC/R manufacturer, HVAC/R technician, or other interested party indicating that maintenance may be required. A triggered alert may take the form of a warning light, a written or coded message on a digital display or user interface in communication with the trap 1200, a text message, a message within an app on a smartphone, an email, and/or a reoccurring sound emanating from the trap or from one or more devices in communication with the controller 1272. Other forms of alerts or alarms can be used to signal maintenance may be required or the presence of mechanical emergency.

In some cases, the controller can include or be coupled to a storage medium for storing historical water level data. This historical data can be provided to a user or another system, or can be leveraged by the controller, such as to determine when to provide a particular notification or warning signal.

Figure 13:
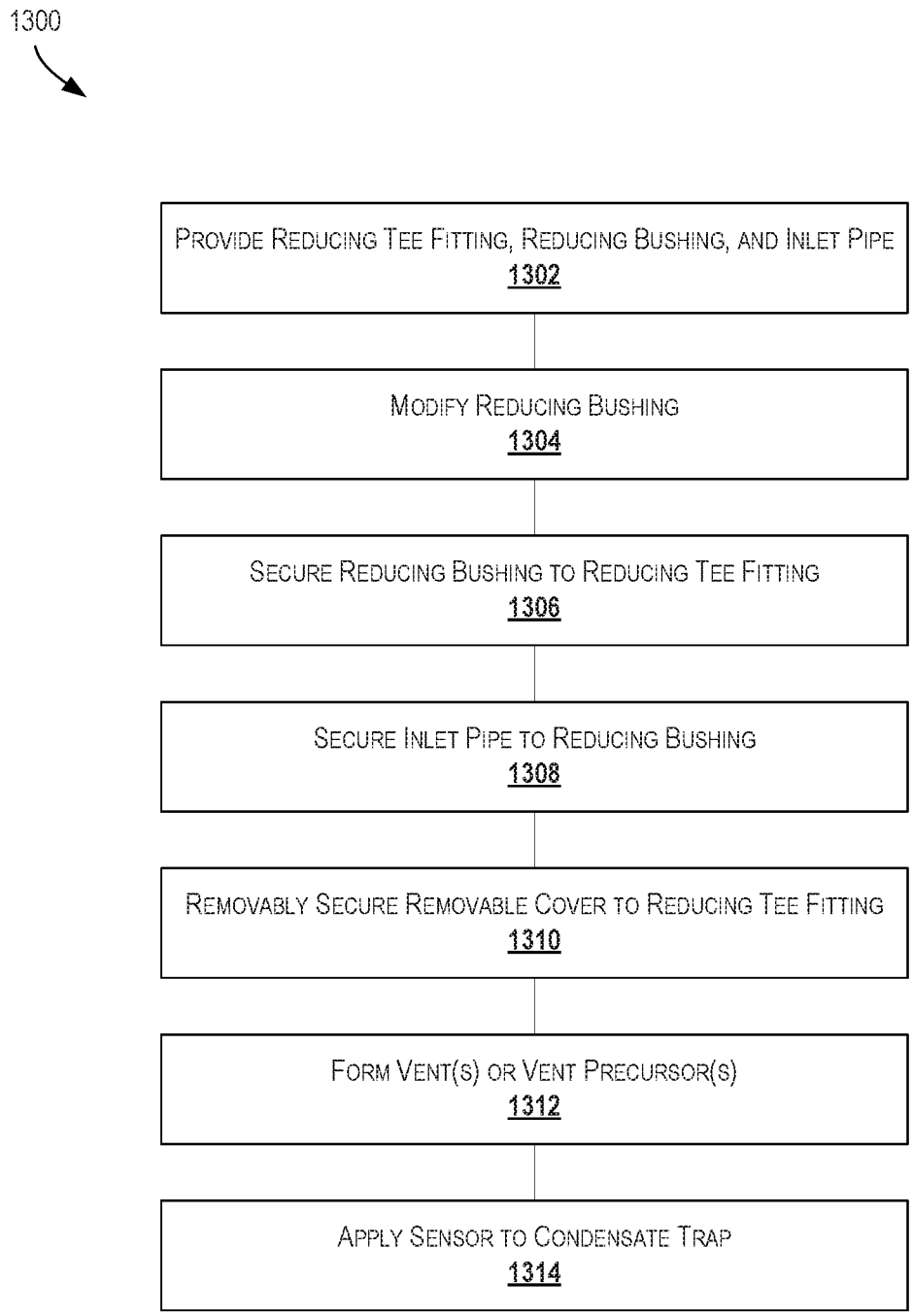
FIG. 13 is a flow chart describing a method of manufacturing a condensate trap according to certain aspects of the present disclosure.

FIG. 13 is a flow chart describing a method 1300 of manufacturing a condensate trap according to certain aspects of the present disclosure. At block 1302, a reducing tee fitting, a reducing bushing, and an inlet pipe are provided. Optionally, an adapter, such as a street male adaptor, and a removable cover can be provided.

At block 1304, the reducing bushing is modified to allow the inlet pipe to pass completely into the inner diameter of the reducing bushing. In some cases, modifying the reducing bushing includes removing an internal lip or shelf from an internal diameter of the reducing bushing. In some cases, modifying the reducing bushing further includes abrading or polishing the internal diameter of the reducing bushing to remove surface inconsistencies that would otherwise hinder a fluid seal between the reducing bushing and the inlet pipe.

At block 1306, the inlet pipe is secured to the reducing bushing. Securing the inlet pipe to the reducing bushing can include applying an affixing agent, such as PVC cement, to a portion of the external surface of the inlet pipe. The inlet pipe can then be passed through the opening of the reducing bushing from bottom to top (e.g., from bottom to top as seen in FIG. 2). Once the inlet pipe is positioned at a desired location, the inlet pipe can be held in place until the affixing agent between the inlet pipe and the reducing bushing is able to provide sufficient hold.

At block 1308, the reducing bushing is secured to the reducing tee fitting. Securing the reducing bushing to the reducing tee fitting can include using threads, affixing agents, and/or any other suitable techniques for securing the reducing bushing to the reducing tee fitting. In some cases, securing the reducing bushing to the reducing tee fitting can include creating a fluid-tight seal between the reducing bushing and the reducing tee fitting, although that need not always be the case.

In some cases, blocks 1306 and 1308 are performed in reverse order. In an example, when the reducing bushing is first secured to the reducing tee fitting, the inlet pipe can be inserted into the reducing tee fitting through an opening opposite the reducing bushing, then passed through the reducing bushing until the bottom end of the inlet pipe has reached a desired position suitable to act as an inlet level (e.g., inlet level 422 of FIG. 4).

At block 1310, the removable cover can be removably secured to the reducing tee fitting. The removable cover can be secured in any fashion described herein. In some cases, removably securing the removable cover to the reducing tee fitting can include securing an adaptor, such as a street male adaptor, to the reducing tee fitting, such as through use of an affixing agent, then removably securing the removable cover to the adaptor, such as through engaging threads.

In some cases, the adaptor and removable cover can removably couple through a bayonet fitting. When a bayonet fitting is used, one of the adaptor or removable cover can include radial pins that engage slots (e.g., L-shaped slots) of the other of the adaptor or removable cover, while a gasket can provide sufficient return force to keep the bayonet fitting secured in a closed position until intentionally opened through a push-turn-release action.

In some cases, the adaptor and removable cover can be permanently or semi-permanently coupled together through a hinge that allows the removable cover to move between an open position and a closed position. A clasp or other securement feature can be located on the adaptor or removable cover to secure the removable cover to the adaptor when in the closed position.

At optional block 1312, one or more vents or vent precursors can be formed (e.g. by drilling) in the trap, such as at one or more of the reducing tee fitting, the reducing bushing, or at other suitable locations. In some cases, forming a vent precursor can include forming a vent and covering the vent with a removable cover.

At optional block 1314, a sensor can be coupled to the trap for sensing a liquid level or a presence of liquid. The sensor can be coupled to the trap through an opening in the trap (e.g., a vent or a separately made opening) or can be secured within or on an external surface of the trap. The sensor can be coupled, by wire or wirelessly, to a controller to enable the sensor's functionality. In some cases, coupling the sensor to the trap can further include calibrating the sensor, such as establishing initial calibration settings for how to report a liquid level depending on the location of the sensor.

Figure 14:
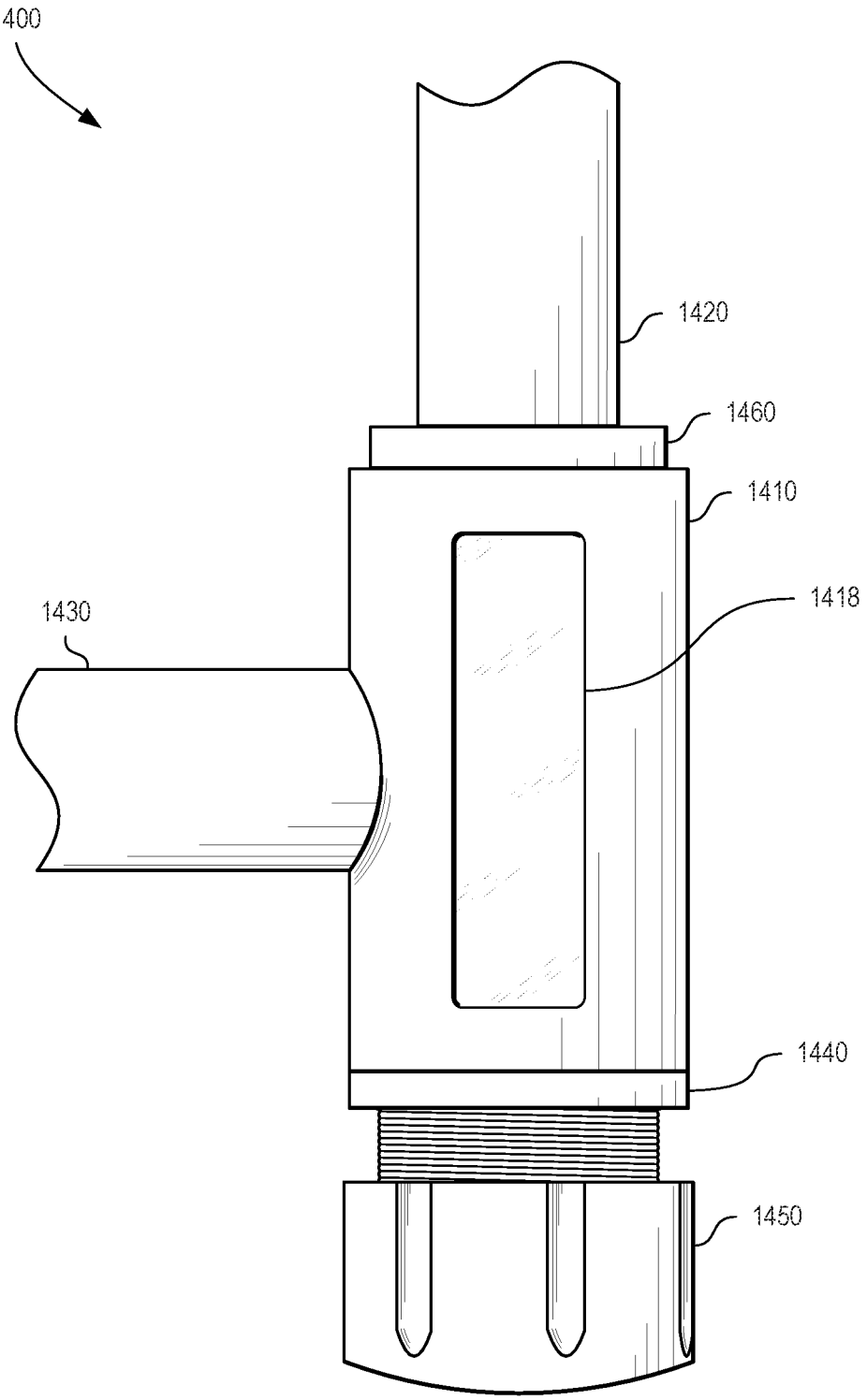
FIG. 14 is a side view depicting a condensate trap having a viewing window according to certain aspects of the present disclosure.

FIG. 14 is a side view depicting a condensate trap 1400 having a viewing window 1418 according to certain aspects of the present disclosure. A portion of the trap 1400, such as the main body 1410, can include a window 1418 providing visual access to the interior of the trap 1400. The window 1418 can be any suitable transparent or translucent material of any suitable shape or size. For example, the window 1418 can be made of a transparent PVC material. In some cases, more than one window 1418 can be used. In some cases, the window 1418 can be incorporated into one or more parts of the trap 1400, such as the main body 1410, a bushing 1460, an inlet pipe 1420, an outlet 1430, an adaptor 1440, or a removable cover 1450. In some cases, one or more parts of a trap 1400 may be made partially or entirely of a translucent or transparent material, such as transparent PVC.

As disclosed above, various parts of a condensate trap can be secured or affixed together. These parts can be secured or affixed together using an affixing agent such as a solvent or an adhesive. The affixing agent can be selected based on the material of the parts being affixed together and the desired bond. For example, a strong bond between PVC parts can be obtained by using a solvent cement (e.g., PVC cement) to chemically weld and/or cement the pieces together. In some cases, a sufficient bond can be obtained through the use of an epoxy or glue. In some cases, galvanized steel and/or steel piping may be affixed using corresponding threading on adjoining parts, with pipe dope or thread seal tape (e.g., Polytetrafluoroethylene (PTFE) tape or plumber's tape) used to help seal the threading. Other suitable materials may be used.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is an apparatus comprising a main body having an inlet, an access port, an outlet, and an interior reservoir fluidly accessible by the inlet, the access port, and the outlet, wherein the inlet includes an inlet pathway extending into the main body to a lower opening that is vertically spaced apart from the outlet by a first distance, wherein the access port is vertically spaced apart from the outlet by a second distance that is greater than the first distance, and wherein a volume of the internal reservoir defined by the first distance is fillable by a liquid to form a gas seal between the inlet and the outlet; and a cover removably couplable to the access port to establish a liquid-tight seal to the interior reservoir at the access port, wherein the interior reservoir is externally accessible when the cover is removed from the access port.

Example 2 is the apparatus of example 1, further comprising at least one vent positioned to expose the internal reservoir to an environment surrounding the apparatus for allowing fluid exiting the outlet to be displaced by gas from the environment, wherein the at least one vent is positioned opposite the gas seal from the inlet.

Example 3 is the apparatus of examples 1 or 2, further comprising at least one vent precursor on the main body, wherein the vent precursor is convertible into a vent for facilitating movement of gas into the main body from a surrounding environment, wherein the at least one vent precursor is positioned opposite the gas seal from the inlet.

Example 4 is the apparatus of examples 1-3, further comprising a sensor positioned in a recess of the main body for outputting a signal indicative of a current liquid level within the main body.

Example 5 is the apparatus of examples 1-4, wherein the second distance is twice the first distance.

Example 6 is the apparatus of examples 1-5, wherein the removable cover is selected from the group consisting of a cap threadable onto the access port, a bayonet fitting couplable to the access port, and a hinged fitting movably coupled to the access port to move between an open position allowing access through the access port and a closed position restricting access to the access port.

Example 7 is the apparatus of examples 1-6, wherein the main body includes a window for providing visual access to the interior reservoir.

Example 8 is the apparatus of examples 1-7, wherein the main body includes a reducing bushing coupled to a reducing tee fitting, wherein the inlet and inlet pathway are defined by an inlet pipe positioned within the reducing bushing such that a first end of the inlet pipe is positioned within the main body and a second end of the inlet pipe is positioned external to the main body.

Example 9 is an apparatus comprising a reducing tee fitting including a top opening, a bottom opening, and a side opening; a cover removably couplable to the bottom opening of the reducing tee fitting to create a liquid tight seal with the bottom opening when the cover is in a closed position; and an inlet pipe coupled to the reducing tee fitting at the top opening by a reducing bushing, wherein the inlet pipe comprises a lower opening positioned within the reducing tee fitting and an upper opening positioned external to the reducing tee fitting, and wherein the lower opening of the inlet pipe is located a distance below the side opening of the reducing tee fitting such that liquid passing through the inlet pipe and collecting within the reducing tee fitting forms a gas barrier between the upper opening of the inlet pipe and the side opening of the reducing tee fitting.

Example 10 is the apparatus of example 9, further comprising at least one vent positioned on the reducing tee fitting or the reducing bushing to facilitate the movement of gas into the reducing tee fitting from a surrounding environment, wherein the at least one vent is positioned opposite the gas barrier from the upper opening of the inlet pipe.

Example 11 is the apparatus of examples 9 or 10, further comprising at least one vent precursor on the reducing tee fitting or the reducing bushing, wherein the vent precursor is convertible into a vent for facilitating movement of gas into the reducing tee fitting from a surrounding environment, wherein the at least one vent precursor is positioned opposite the gas barrier from the upper opening of the inlet pipe.

Example 12 is the apparatus of examples 9-11, wherein the reducing tee fitting further comprises a sensor for outputting a signal representative of a current liquid level within the main body.

Example 13 is the apparatus of examples 9-12, wherein the lower opening of the inlet pipe is positioned approximately halfway between the removable cover and the side opening.

Example 14 is the apparatus of examples 9-13, wherein the removable cover is selected from the group consisting of a cap threadable onto the lower opening of the main body, a bayonet fitting couplable to the lower opening of the main body, and a hinged fitting movably coupled to the lower opening of the main body to move between an open position allowing access through the lower opening of the main body and a closed position restricting access to the lower opening of the main body.

Example 15 is the apparatus of examples 9-14, further comprising a window positioned in at least one of the reducing tee fitting, the cover, or the reducing bushing, wherein the window is made of a transparent or translucent material, and wherein the window is positioned to provide visual access into the reducing tee fitting.

Example 16 is a method of manufacturing a condensate trap comprising modifying a reducing bushing to accept an inlet pipe there through; securing the reducing bushing to a reducing tee fitting having an outlet and an access port, wherein the reducing bushing is vertically offset from the outlet by a first distance; securing the inlet pipe to the reducing bushing by passing the inlet pipe through the reducing bushing, wherein securing the inlet pipe to the reducing bushing includes positioning the inlet pipe such that a lower end of the inlet pipe is vertically offset from the reducing bushing by a second distance that is greater than the first distance; removably securing a removable cover to the reducing tee fitting at the access port to create a liquid-tight seal at the access port.

Example 17 is the method of example 16, wherein securing the inlet pipe to the reducing bushing further includes applying an affixing agent to the inlet pipe prior to inserting a top end of the inlet pipe into the reducing bushing, wherein the top end of the inlet pipe is positioned outside of the reducing tee fitting when the inlet pipe is secured to the reducing bushing.

Example 18 is the method of examples 16 or 17, further comprising forming at least one vent or vent precursor in at least one of the reducing bushing and the reducing tee fitting at a location opposite the outlet from the lower end of the inlet pipe.

Example 19 is the method of examples 16-18, further comprising coupling a sensor to at least one of the reducing bushing and the reducing tee fitting for outputting a signal indicative of a current liquid level within the reducing tee fitting.

Example 20 is the method of examples 16-19, wherein removably securing the removable cover to the reducing tee fitting comprises coupling an adaptor to the reducing tee fitting at the access port; and one selected from the group consisting of: threading the removable cover onto the adaptor; locking the removable cover onto the adaptor through a bayonet fitting; and moving the removable cover from an open position to a closed position, wherein the removable cover is coupled to the adaptor by a hinge.

What is claimed is:

1. An HVAC/R apparatus comprising:

an inlet pipe having a body and defining an inlet pipe opening;

a main body having an inlet, an access port, an outlet, and an interior reservoir, wherein the inlet is aligned with the access port, wherein the interior reservoir is in fluid communication with the inlet, the access port, and the outlet such that a fluid flow path is defined through the HVAC/R apparatus, wherein the inlet pipe extends through the inlet of the main body such that the inlet pipe opening is vertically spaced below the outlet of the main body wherein a volume of the internal reservoir defined by the first distance is fillable by a liquid to form a gas seal between the inlet and the outlet; and a cover removably couplable to the access port to establish a liquid-tight seal to the interior reservoir at the access port, wherein the interior reservoir is externally accessible via the access port when the cover is removed from the access port;

a reducing bushing coupled to the main body and at least partially positioned within the inlet of the main body, the reducing bushing comprising a top end and a bottom end, the bottom end of the reducing bushing positioned within the main body and above the outlet, the reducing bushing defining at least one vent extending through the reducing bushing from the top end to the bottom end of the reducing bushing, the at least one vent configured to expose the internal reservoir of the main body to an environment surrounding the apparatus for allowing fluid exiting the outlet to be displaced by gas from the environment.

2. The HVAC/R apparatus of claim 1, further comprising a sensor positioned in a recess of the main body for outputting a signal indicative of a current liquid level within the main body.

3. The HVAC/R apparatus of claim 1, wherein a distance between the inlet pipe opening and the outlet of the main body is greater than distance between the access port and the outlet of the main body.

4. The HVAC/R apparatus of claim 1, wherein the removable cover is selected from a group consisting of a cap threadable onto the access port, a bayonet fitting couplable to the access port, and a hinged fitting movably coupled to the access port to move between an open position allowing access through the access port and a closed position restricting access to the access port.

5. The HVAC/R apparatus of claim 1, wherein the main body includes a window for providing visual access to the interior reservoir.

6. The HVAC/R apparatus of claim 1, wherein the inlet pipe extends through the reducing bushing such that a first end of the inlet pipe is positioned within the main body and a second end of the inlet pipe is positioned external to the main body.

7. The HVAC/R apparatus of claim 1, wherein the apparatus defines a fluid flow path through the HVAC/R apparatus (i) along the inlet pathway, (ii) through the lower opening, and (iii) through the interior reservoir to the outlet, and wherein the fluid flow path is an unobstructed fluid flow path.

8. The HVAC/R apparatus of claim 1, wherein the inlet pipe opening is at a location with $^{25}$% of a halfway between the outlet and the access port of the main body.

9. A method of assembling the HVAC/R apparatus of claim 1, the method comprising: coupling the reducing bushing to the main body such that the reducing bushing is at least partially positioned within the inlet of the main body;

coupling the cover to the access port of the main body;

inserting the inlet pipe through the reducing bushing; and coupling the inlet pipe to conduit of an HVAC/R system.

* * * * *